US009242486B2

(12) United States Patent
Verhofstad

(10) Patent No.: US 9,242,486 B2
(45) Date of Patent: Jan. 26, 2016

(54) PRINTING APPARATUS FOR PRINTING ON A PRINT SUBSTRATE

(71) Applicant: OCÉ-Technologies B.V., Venlo (NL)

(72) Inventor: Wilhelmus J. E. G. Verhofstad, Vierlingsbeek (NL)

(73) Assignee: Océ-Technologies B.V., Venlo (NL)

( * ) Notice: Subject to any disclaimer, the term of this patent is extended or adjusted under 35 U.S.C. 154(b) by 0 days.

(21) Appl. No.: 14/792,258

(22) Filed: Jul. 6, 2015

(65) Prior Publication Data

US 2015/0343810 A1 Dec. 3, 2015

Related U.S. Application Data

(63) Continuation of application No. PCT/EP2014/050793, filed on Jan. 16, 2014.

(30) Foreign Application Priority Data

Jan. 17, 2013 (EP) ..... 13151544

(51) Int. Cl.
*B41J 3/60* (2006.01)
*B41J 13/00* (2006.01)

(52) U.S. Cl.
CPC ..... *B41J 13/0009* (2013.01); *B41J 3/60* (2013.01)

(58) Field of Classification Search
CPC combination set(s) only.
See application file for complete search history.

(56) References Cited

U.S. PATENT DOCUMENTS

2011/0211897 A1 9/2011 Uchida et al.
2014/0037354 A1 * 2/2014 Araki ..... 400/76

FOREIGN PATENT DOCUMENTS

| | | | | |
|---|---|---|---|---|
| EP | 1 637 334 A1 | | 3/2006 | |
| FR | 2.067.672 | | 8/1971 | |
| GB | 2 102 769 A | | 2/1983 | |
| GB | 2138404 | * | 10/1984 | ..... B65H 18/02 |
| JP | 2008-126530 | * | 6/2008 | ..... B41J 2/01 |
| JP | 2011-143628 A | | 7/2011 | |

* cited by examiner

*Primary Examiner* — Huan Tran
(74) *Attorney, Agent, or Firm* — Birch, Stewart, Kolasch & Birch, LLP

(57) ABSTRACT

The present invention relates to a printing apparatus for printing on a print substrate. The printing apparatus comprises: a printing station comprising a printing assembly for printing a first image on a first side of the print substrate during a first pass of the print substrate and printing a second image on a second side of the print substrate during a second pass of the print substrate; an input station for supplying the print substrate to the printing station; an output station for receiving the print substrate from the printing station, the output station comprising: a carrousel, the carrousel comprising at least two roll-up units, the carrousel being movable in a plurality of positions, in each of which a first roll-up unit of the at least two roll-up units is arranged in a substrate receiving position and a second roll-up unit of the at least two roll-up units is arranged in a position of the group of a substrate feeding position and a roll unloading position, wherein the roll-up unit in the substrate receiving position is adapted for receiving the print substrate, thereby forming a roll, and wherein the roll unloading position is different in location from the substrate receiving position.

14 Claims, 14 Drawing Sheets

--Prior Art--

PRINTING APPARATUS FOR PRINTING ON A PRINT SUBSTRATE

CROSS REFERENCE TO RELATED APPLICATIONS

This application is a Continuation of PCT International Application No. PCT/EP2014/050793, filed on Jan. 16, 2014, which claims priority under 35 U.S.C. 119(a) to patent application Ser. No. 13/151,544.7, filed in Europe on Jan. 17, 2013, all of which are hereby expressly incorporated by reference into the present application.

FIELD OF THE INVENTION

The present invention relates to a printing apparatus for printing on a print substrate. The present invention further relates to an output device for receiving and feeding a print substrate for use in a printing system. The present invention further relates to a method for operating a printing apparatus.

BACKGROUND OF THE INVENTION

A known printing apparatus for printing roll-to-roll comprises an input station on a front side of the printing apparatus, an output station on a back side of the printing apparatus and a printing station. The output station comprises one roll-up unit for receiving a print substrate from the printing station. In a first step of a known duplex printing process the print substrate is fed from a roll in the input station to a printing station for printing a first image on a first side of the print substrate. The print substrate, bearing the first image, is received in the output station. The print substrate is manually attached to the roll-up unit by the operator and is thereafter wind in the roll-up unit in the output station thereby forming a roll of the print substrate. In case of a need for printing duplex on the print substrate, the roll, bearing the first image, is unloaded from the roll-up unit in the output station by an operator and reloaded into the input station. In a second step the print substrate, bearing the first image, is fed from the input station to the printing station for printing a second image on a second side of the print substrate. The print substrate, bearing the first image and the second image, is received on the roll-up unit in the output station thereby forming a roll of the print substrate. The unloading and loading of the roll of the print substrate in the known printing apparatus interrupts the printing operation of the printing apparatus and reduces the productivity of the duplex output. For more productive roll-to-roll printing a need exists for automatic duplex printing without interruption of the duplex printing operation and a possibility of unloading a roll from the output station independent of the printing operation of the printing apparatus.

SUMMARY OF THE INVENTION

It is accordingly an object of the present invention to provide a printing apparatus for automatic duplex printing on a printing substrate wherein the printing substrate is received as a roll in an output station and for unloading the roll from the output station without interrupting the printing operation of the printing apparatus.

In GB2102769 an unwind-rewind unit for web treatment is disclosed. During treatment of each side of the web, the web is unwound from one mandrel of a rotatable turret and rewound on another mandrel of the same turret. The unwind-rewind unit of GB2102769 is both used as the input station and the output station of the web. GB2102769 does not disclose an input station for supplying a web, the input station being arranged remote from the output station.

This object is attained by a printing apparatus for printing on a print substrate, the printing apparatus comprising:

- a printing station comprising a printing assembly for printing a first image on a first side of the print substrate during a first pass of the print substrate and printing a second image on a second side of the print substrate during a second pass of the print substrate;
- an input station for supplying the print substrate to the printing station, the input station comprising at least one roll unit for supplying a print substrate;
- an output station for receiving the print substrate from the printing station, the output station comprising:
- a carrousel, the carrousel comprising at least two roll-up units, the carrousel being movable in a plurality of positions, in each of which a first roll-up unit of the at least two roll-up units is arranged in a substrate receiving position and a second roll-up unit of the at least two roll-up units is arranged in a position of the group of a substrate feeding position and a roll unloading position, wherein the roll-up unit in the substrate receiving position is adapted for receiving the print substrate, thereby forming a roll, and wherein the roll unloading position is different in location from the substrate receiving position;

the input station being arranged remote from the output station;

the printing apparatus further comprising an input control mechanism adapted for selecting an input source for feeding the print substrate towards the printing station from one of the input station and the output station.

The printing apparatus is adapted for executing automatic duplex printing on a printing substrate. The printing substrate is supplied to the printing station, e.g. supplied from an input station. The printing substrate may be stored in the input station as a roll or as a sheet.

The input station is adapted for supplying the print substrate to the printing station. For example in case of providing a first image on the printing substrate in a duplex printing mode or a simplex printing mode the print substrate may be supplied by the input station. The input station comprises at least one roll unit. Each roll unit may hold a roll of printing substrate. Each roll unit is adapted for on demand supplying the printing substrate from the roll to the printing station.

The input station preferably comprises a plurality of rolls of printing substrates, wherein in an embodiment each roll may be of different size and/or of different substrate material (e.g. plain paper, coated paper, vinyl, etc.).

The printing station may comprise a printing assembly which is arranged facing one side of the printing substrate during a pass of the printing substrate through the printing station. The printing station is configured for printing a first image on a first side of the print substrate during a first pass of the print substrate and printing a second image on a second side of the print substrate during a second pass of the print substrate. The printing station may be toner based printing station and may be an inkjet printing station.

The printing assembly may comprise a number of inkjet print heads. The inkjet print heads may be a full page in-line printing assembly which is arranged facing the printing substrate thereby extending over the width of the printing substrate. Alternatively the inkjet print heads may be reciprocately moved over the width of the printing substrate perpendicular to the transport direction of the printing substrate through the printing station.

The print substrate, bearing the first image on the first side, is moved to the output station. The output station comprises a substrate receiving position, a substrate feeding position and a roll unloading position. As used herein the substrate receiving position is connected to a transport path of the printing substrate from the printing station to the output station. Furthermore the substrate receiving position of the output station is adapted to receive the printing substrate from the printing station thereby forming a roll. As used herein the substrate feeding position is connected to a transport path of the printing substrate from the output station to the printing station. The substrate feeding position of the output station is adapted to feed the print substrate from the roll to the printing station. During duplex printing the printing substrate, bearing the first image, is fed from the substrate feeding position to the printing station for printing a second image on the printing substrate during a second pass through the printing station.

The output station comprises a carrousel. The carrousel comprises at least two roll-up units. Each of the at least two roll-up units is connected to the carrousel. The number of roll-up units may be suitably selected based on the productivity of the printing system and the variety of print substrates (sizes and substrate material) used. For example for supporting an unattended production (e.g. overnight) of a plurality of print jobs the number of roll-up units may be selected based on the number of print jobs, the type of print jobs (e.g. simplex and duplex), and the substrate materials to be used.

The carrousel is movable in a plurality of positions, thereby accordingly moving each of the at least two roll-up units. The carrousel is movable in a plurality of positions along the substrate receiving position, the substrate feeding position and the roll unloading position.

Each roll-up unit is adapted to receive the print substrate thereby forming a roll in case the roll-up unit is arranged in the substrate receiving position. Each of the roll-up units is adapted to unwind the roll and feed the print substrate in case the roll-up unit is arranged in the substrate feeding position.

In each of the plurality of positions of the carrousel a first roll-up unit of the at least two roll-up units is arranged in the substrate receiving position and a second roll-up unit of the at least two roll-up units is arranged in a position of the group of the substrate feeding position and the roll unloading position.

The roll unloading position is different in location from the substrate receiving position. As used herein the roll unloading position is adapted to be easily accessible by an operator for unloading the roll from the output station. The roll unloading position may be suitably selected, e.g. at a certain height for enabling ergonomic handling of the roll by the operator, independent of the substrate receiving position.

The roll unloading position may be the same in location as the substrate feeding position and may be different in location from the substrate feeding position. In case the roll unloading position is the same in location as the substrate feeding position, a roll may be unloaded without interrupting the printing operation during printing and receiving a printing substrate bearing a first image on a first side. In case the roll unloading position is different in location from the substrate feeding position, a roll may be unloaded without interrupting the printing operation while printing a first image on a first side or while printing a second image on a second side.

In case the second roll-up unit is arranged in the substrate feeding position, a roll, bearing the first image, may be fed to the printing station for printing the second image on the print substrate while the print substrate, bearing the second image, may be received in the substrate receiving position thereby forming a roll.

In case the second roll-up unit is arranged in the roll-unloading position a roll may be taken from the output station while the print substrate, bearing the first image, may be received in the substrate receiving position thereby forming a roll.

The printing apparatus according to the invention comprising the carrousel holding the roll up-units enables the automatic duplex printing on a printing substrate wherein the printing substrate is formed as a roll in an output station and enables unloading the roll from the output station without interrupting the printing operation of the printing apparatus.

The input station is arranged remote from the output station. The input station may comprise a loading position for loading a roll of a printing substrate onto a roll unit of the input station. The roll of printing substrate may be loaded onto a roll unit in the input station while the printing apparatus performs printing on a printing substrate which is supplied from another roll unit of the input station or while the printing substrate is supplied from a roll unit of the output station.

The printing apparatus further comprising an input control mechanism adapted for selecting an input source for supplying the print substrate towards the printing station from one of the input station and the output station. The input control mechanism may comprise a part of a control unit adapted for selecting an input source from one of the input station and the output station.

In an embodiment the input control mechanism may be adapted to select the input source in response to a simplex printing mode or a duplex printing mode. For example in case of providing a first image on a printing substrate in a simplex printing mode the input station is selected by the input control mechanism as input source. In another example in case of a duplex printing mode the input station is selected by the input control mechanism as input source in a first pass for providing the first image on the first side of the printing substrate and subsequently the output station is selected by the input control mechanism as input source in a second pass for providing the second image on the second side of the printing substrate.

In an embodiment the printing apparatus may further comprise a feeding path switch adapted for guiding the print substrate from the selected input source to the printing station, the feeding path switch being in operation movable in one of a first state for selectively guiding a print substrate provided from the input station and a second state for selectively guiding a print substrate provided from the output station. The input control mechanism may control the state of the feeding path switch. The feeding path switch may be in operation moveable in the first state and in the second state in response to the input control mechanism.

The feeding path switch may be arranged at a feeding path joining position, where an input transport path, which comes from the input station, and a second transport path, which comes from the output station, join together. The input transport path is arranged for feeding the print substrate from the input station to the printing station. The second transport path is arranged for feeding the print substrate from the substrate feeding position of the output station to the printing station. The input transport path and the second transport path have a collective portion arranged between the feed path joining position and the printing station.

The feeding path switch may be a valve or may be a control gate, which control gate may be angularly movable with respect to a rotatable shaft. The control gate may comprise one or more vanes, each vane adapted for providing a passageway for the print substrate. The vane may optionally being curved to deflect the print substrate through an appreciable angle in the transport path towards the printing station.

The input control mechanism may further be adapted for driving one of the input transport path and the second transport path for feeding the print substrate to the printing station in response to the selected input source.

Optionally the printing apparatus may further comprise a substrate turning mechanism for turning the print substrate such that the second side of the print substrate faces the printing assembly during the second pass of the print substrate. However in the printing apparatus according to the invention the turning mechanism may also be provided by one of the at least two roll-up units of the carrousel. In the particular example the roll-up unit may be arranged between a first transport mechanism for feeding the print substrate from the printing station to the roll-up and a second transport mechanism for feeding the print substrate from the roll-up unit to the printing station. By forming a roll of the printing substrate in the roll-up unit a leading edge of the print substrate and a trailing edge are mutually changed with respect to the direction of transport of the print substrate. In case the second transport mechanism directs the print substrate to the same entrance of the print station as in the first pass, the trailing edge during the first pass of the print substrate is the leading edge during the second pass of the print substrate through the print station and the second side of the print substrate faces the printing assembly during the second pass of the print substrate.

Alternatively the turning mechanism may comprise a roll-to-roll turn mechanism in the output station by converting a roll into a roll thereby mutually exchanging the leading edge and the trailing edge of the print substrate. This embodiment of the turning mechanism can be applied in a carrousel according to the invention in case the leading edge of the print substrate is fed in a circulation path from an exit position of the print station back to the exit position for a second pass through the print station in a transport direction opposite to the transport direction during the first pass through the print station. In this way also the second side of the print substrate faces the printing assembly during the second pass of the print substrate.

In even another embodiment the turning mechanism may comprise a roll turning mechanism that turns the print substrate when retained as a roll in a roll-up unit by rotating the roll-up unit in a direction perpendicular to the axis of the roll-up unit. Many other mechanisms for turning the print substrate are known to a person skilled in the art during transport of the print substrate, e.g. by transporting the print substrate in a helical movement.

In an embodiment of the printing apparatus, the substrate feeding position is the same in location as the substrate receiving position, and wherein in each position of the carrousel said second roll-up unit of the at least two roll-up units is arranged in the roll unloading position. This embodiment supports a compact carrousel design while providing a duplex functionality.

In an embodiment of the printing apparatus, the substrate feeding position is different in location from the substrate receiving position. This embodiment supports a duplex functionality wherein the duplex print substrate, bearing the first and second image, may be directly received from the print station on a roll-up unit of the carrousel.

In a particular embodiment, the input control mechanism is adapted for selecting a first position of the carrousel in response to a duplex printing mode, said first position of the carrousel adapted for receiving the print substrate on a first roll-up unit in the substrate receiving position in a first pass for providing the first image on the first side of the print substrate, based on an unoccupied roll-up unit being arrangable in the substrate receiving position during the second pass of the print substrate for providing the second image on the second side of the print substrate.

In a second position of the carrousel the first roll-up unit is arranged in the substrate feeding position during the second pass of the print substrate. In this embodiment said first position is selected by the input control mechanism in case in the corresponding second position of the carrousel an unoccupied second roll-up unit is arranged in the substrate receiving position. Depending on the type and order of printing jobs some of the roll-up units of the carrousel may be unoccupied, while others may be occupied. The input control mechanism is adapted to select a first position of the carrousel and to controllably move the carrousel in said first position based on the knowledge of the status (occupied or unoccupied) of the respective roll-up units of the carrousel. In particular information regarding the status of the respective roll-up units of the carrousel (occupied or unoccupied) is stored on the control unit of the printing apparatus and is provided to the input control mechanism.

In an embodiment of the printing apparatus, the roll unloading position is the same in location as the substrate feeding position. This embodiment supports a compact carrousel design while providing a duplex functionality wherein the duplex print substrate, bearing the first and second image, may be directly received from the print station on a roll-up unit of the carrousel.

In an embodiment of the printing apparatus, the roll unloading position is different in location from the substrate feeding position, and wherein the carrousel supports at least three roll-units, wherein in each of position of the carrousel a third roll-up unit of the at least three roll-up units is arranged in the roll unloading position. This embodiment supports a suitable selection of the roll unloading position independent of the substrate feeding position and the substrate receiving position of the output station. In this way an interface of the output station to the transport paths which are connected to the print station may be optimized independent of the roll-unloading position.

In an embodiment of the printing apparatus, each roll-up unit comprises a spindle and the carrousel comprises for each roll-up unit: a winding mechanism for winding the print substrate around the spindle in order to form the roll; an unwinding mechanism for unwinding the print substrate from the spindle; and a retaining mechanism adapted to retain the free end of the roll of print substrate in a fixed position with respect to the spindle. The retaining mechanism may retain the free end of the roll in the print substrate receiving position while forming the roll and continue to retain the free end when the roll-up unit is arranged in the substrate feeding position. In this way the retaining mechanism supports a fast and easy feeding of the free end of the print substrate into a transport path towards the print station.

In an embodiment of the printing apparatus, the carrousel is rotatable about an axis and wherein the plurality of positions of each of the roll-up units is arranged along a circular path. Alternatively the carrousel may be an endless conveyer system, and the carrousel may be movable along a predefined path. For example the carrousel may comprise a pair of endless chains, wherein a roll-unit is connected at each end to one of the endless chains. The endless chains may be movable along the predefined path by at least two transport rollers.

In another aspect of the invention an output device is provided for receiving and feeding a print substrate for use in a printing system, the output device comprising: a carrousel, the carrousel comprising at least two roll-up units, the carrousel being movable in a plurality of positions, in each of which a first roll-up unit of the at least two roll-up units is arranged in a substrate receiving position and a second roll-up unit of the at least two roll-up units is arranged in one position of the group of a substrate feeding position and a roll unloading position, wherein the roll-up unit in the substrate receiving position is adapted for receiving the print substrate, thereby forming a roll, and wherein the roll unloading position is different in location from the substrate receiving position. The output device supports the method according to the invention when the output device is applied in a printing system.

In an embodiment of the output device, the carrousel supports at least three roll-up units, the carrousel being movable in a plurality of positions, in each of which the first roll-up unit of the at least three roll-up units is arranged in the substrate receiving position, the second roll-up unit of the at least three roll-up units is arranged in the substrate feeding position and a third roll-up unit of the at least three roll-up units is arranged in the roll unloading position.

In an embodiment of the output device, each roll-up unit comprises a spindle and the carrousel comprises for each roll-up unit: a winding mechanism for winding the print substrate around the spindle in order to form a roll; an unwinding mechanism for unwinding the print substrate from the spindle; and a retaining mechanism adapted to retain the free end of the roll of print substrate in a fixed position with respect to the spindle.

In another aspect of the invention, a method is provided for operating a printing apparatus, the printing apparatus comprising: a printing station, an input station and an output station, the printing station comprising a printing assembly, wherein the output station comprises a carrousel, the carrousel being movable in a plurality of positions, the carrousel comprising at least two roll-up units, the method comprising the steps of: selecting one of the input station and the output station as the supply source and supplying a print substrate from the selected supply source to the printing station; providing a first image on a first side of the print substrate in the printing station; arranging the carrousel in one position of the plurality of positions, in which position a first roll-up unit of the at least two roll-up units is arranged in a substrate receiving position and a second roll-up unit of the at least two roll-up units is arranged in one position of the group of a substrate feeding position and a roll unloading position, wherein the roll unloading position is different in location from the substrate receiving position; receiving the print substrate, bearing the first image, on the first roll-up unit of the at least two roll-up units, which is arranged in the substrate receiving position, thereby forming a roll; unwinding the roll from the first roll-up unit of the at least two roll-up units, which is arranged in the substrate feeding position, and feeding the print substrate to the printing station; and providing a second image on a second side of the print substrate in the printing station.

Optionally the method further comprises the step of: turning the print substrate such that a second side of the print substrate faces the printing assembly in the printing station. In a preferred embodiment each of the roll-up units in the method may provide the turning step by the winding step of the print substrate on the roll-up unit and the unwinding step of the roll from the roll-up unit, thereby mutually exchanging the leading edge and the trailing edge of the print substrate.

In an embodiment of the method, the substrate feeding position during the unwinding and feeding step of the print substrate is the same in location as the substrate receiving position during the receiving step of the print substrate, and wherein in the carrousel arranging step the second roll-up unit of the at least two roll-up units is arranged in the roll unloading position. This embodiment supports a fast duplex printing process without moving the carrousel in between the first printing step of the first image and the second printing step of the second image.

In an embodiment of the method, the substrate feeding position of the roll-up unit during the unwinding and feeding step of the print substrate is different in location from the substrate receiving position during the receiving step of the print substrate, and the method further comprises the step of: arranging the carrousel in one position of the plurality of positions, in which position the first roll-up unit of the at least two roll-up units is arranged in the substrate feeding position and the second roll-up unit of the at least two roll-up units is arranged in the substrate receiving position; wherein the second carrousel arranging step is carried out after the receiving step of the print substrate and before the unwinding and feeding step of the print substrate. This embodiment supports a printing process wherein the print substrate of the roll-up unit in the substrate feeding position may be fed at the same time as receiving a print substrate on the roll-up unit in the substrate receiving position. In particular a duplex printing process may be supported, wherein the duplex print substrate, bearing the first and second image, is received from the print station on the roll-up unit of the carrousel in the substrate receiving position.

In an embodiment of the method, the method further comprises the step of: receiving the print substrate, bearing the first image and the second image, on the second roll-up unit of the at least two roll-up units in the substrate receiving position thereby forming a roll; wherein the second receiving step of the print substrate is carried out after the step of providing a second image on the second side of the print substrate. This embodiment supports a duplex printing process wherein the duplex print substrate, bearing the first and second image, is received from the print station on a roll-up unit of the carrousel.

In a particular embodiment of the method, the method further comprises the step of selecting a first position of the carrousel in response to a duplex printing mode and based on the knowledge of the status of the respective roll-up units of the carrousel, said first position of the carrousel being adapted for receiving the print substrate on the first roll-up unit in the first receiving step and for receiving the print substrate on the second roll-up unit in the second receiving step, and wherein in the first carrousel arranging step the carrousel is arranged in the first position.

Depending on the type and order of printing jobs some of the roll-up units of the carrousel may be unoccupied, while others may be occupied. The knowledge of the status (occupied or unoccupied) of the respective roll-up units of the carrousel is used to select the first position of the carrousel.

In an embodiment of the method, the roll unloading position is different in location from the substrate feeding position and the carrousel supports at least three roll-up units and wherein in the second carrousel arranging step a third roll-up unit of the at least three roll-up units is arranged in the roll unloading position. This embodiment supports an unloading procedure of the roll in the roll unloading position independent of the printing process.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given herein below and the accompanying schematical drawings which are given by way of illustration only, and thus are not limitative of the present invention, and wherein.

DETAILED DESCRIPTION OF EMBODIMENTS

Figure 1A:
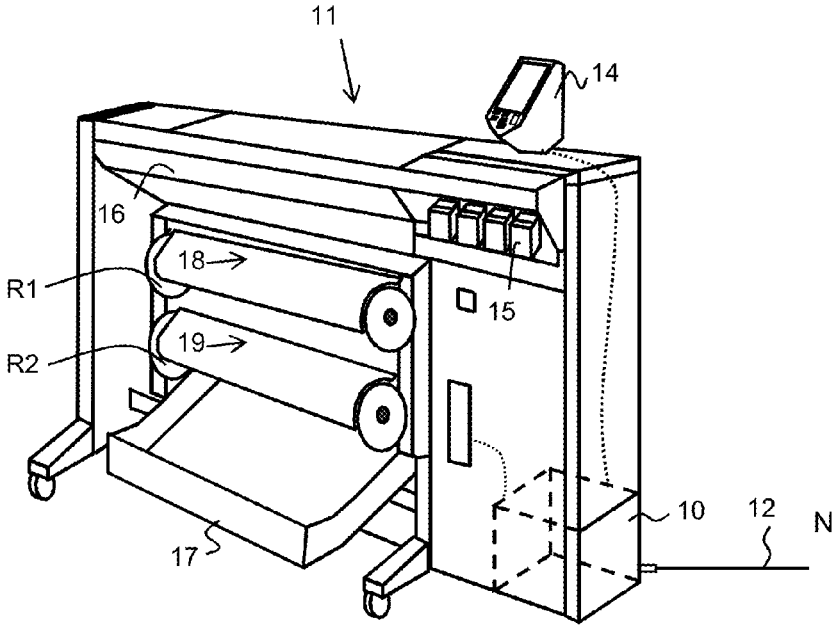
FIG. 1A shows an image forming apparatus, wherein printing is achieved using a wide format inkjet printer.

The present invention will now be described with reference to the accompanying drawings, wherein the same reference numerals have been used to identify the same or similar elements throughout the several views.

Figure 1B:
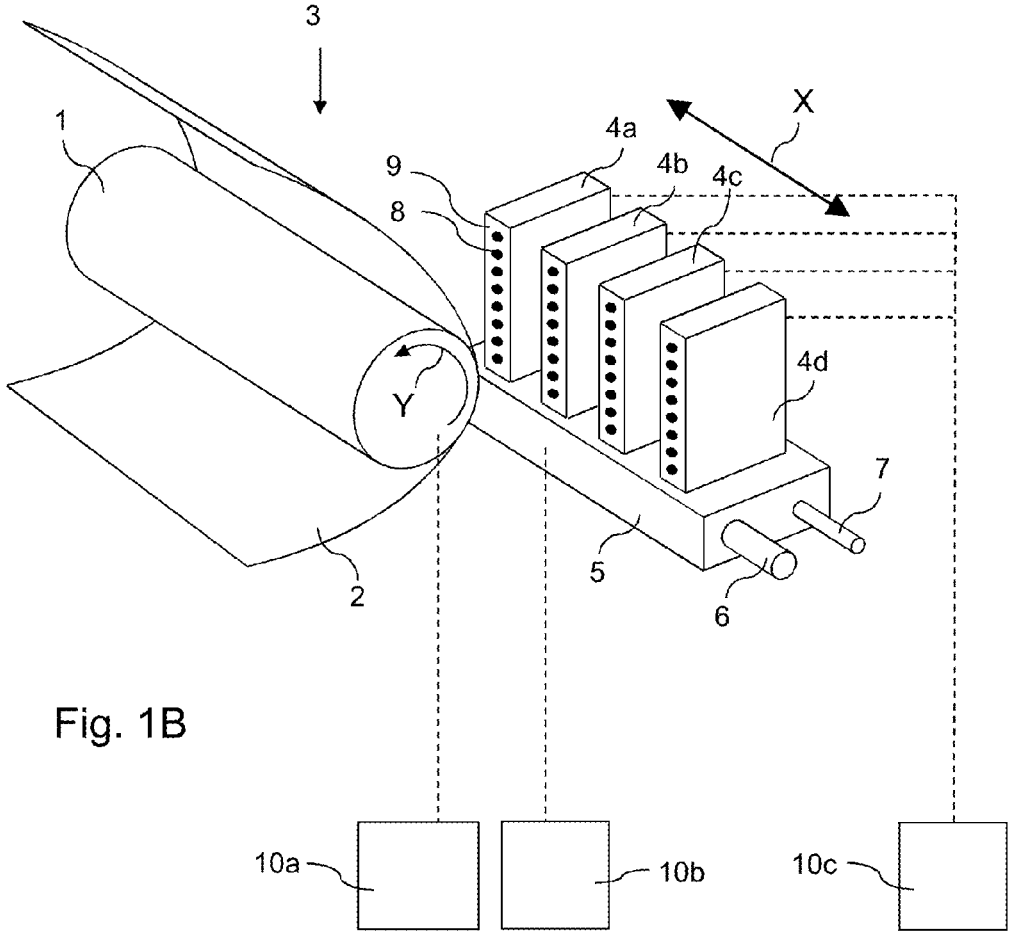
FIG. 1B shows an ink jet printing assembly.

FIG. 1A shows an image forming apparatus 11, wherein printing is achieved using a wide format inkjet printer. The wide-format image forming apparatus 11 comprises a housing 16, wherein the printing assembly, for example the ink jet printing assembly shown in FIG. 1B is placed. The image forming apparatus 11 also comprises an input station for storing print substrate 18, 19, an output station to collect the print substrate 18, 19 after printing and a storage unit for storing marking material 15. In FIG. 1A, the output station is embodied as a delivery tray 17. Optionally, the output station may comprise a processing mechanism for processing the print substrate 18, 19 after printing, e.g. a roll-up unit, a folder or a puncher. The wide-format image forming apparatus 11 furthermore comprises units for receiving print jobs and optionally units for manipulating print jobs. These units may include a user interface unit 14 and/or a control unit 10, for example a computer.

Images are printed on a print substrate, for example paper, supplied by a roll 18, 19. The roll 18 is supported on the roll support R1, while the roll 19 is supported on the roll support R2. Alternatively, cut sheet print substrates may be used instead of rolls 18, 19 of print substrate. Printed sheets of the print substrate, cut off from the roll 18, 19, are deposited in the delivery tray 17.

Each one of the marking materials for use in the printing assembly are stored in four containers 15 arranged in fluid connection with the respective print heads for supplying marking material to said print heads.

The local user interface unit 14 is integrated to the print engine and may comprise a display unit and a control panel. Alternatively, the control panel may be integrated in the display unit, for example in the form of a touch-screen control panel. The local user interface unit 14 is connected to a control unit 10 placed inside the printing apparatus 11. The control unit 10, for example a computer, comprises a processor adapted to issue commands to the print engine, for example for controlling the print process. The image forming apparatus 11 may optionally be connected to a network N. The connection to the network N is diagrammatically shown in the form of a cable 12, but nevertheless, the connection could be wireless. The image forming apparatus 11 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises a supporting mechanism for supporting a print substrate 2. The supporting mechanism is shown in FIG. 1B as a platen 1, but alternatively, the supporting mechanism may be a flat surface. The platen 1, as depicted in FIG. 1B, is a rotatable drum, which is rotatable about its axis as indicated by arrow Y. The supporting mechanism may be optionally provided with suction holes for holding the print substrate in a fixed position with respect to the supporting mechanism. The ink jet printing assembly 3 comprises print heads 4*a*-4*d*, mounted on a scanning print carriage 5. The scanning print carriage 5 is guided by suitable guiding mechanism 6, 7 to move in reciprocation in the main scanning direction B. Each print head 4*a*-4*d* comprises an orifice surface 9, which orifice surface 9 is provided with at least one orifice 8. The print heads 4*a*-4*d* are configured to eject droplets of marking material onto the print substrate 2. The platen 1, the carriage 5 and the print heads 4*a*-4*d* are controlled by suitable controlling units 10*a*, 10*b* and 10*c* of the control unit 10, respectively.

The print substrate 2 may be a medium in web or in sheet form and may be composed of e.g. paper, cardboard, label stock, coated paper, plastic or textile. Alternatively, the print substrate 2 may also be an intermediate member, endless or not. Examples of endless members, which may be moved cyclically, are a belt or a drum. The print substrate 2 is moved in the sub-scanning direction Y by the platen 1 along four print heads 4*a*-4*d* provided with a fluid marking material.

A scanning print carriage 5 carries the four print heads 4*a*-4*d* and may be moved in reciprocation in the main scanning direction X parallel to the platen 1, such as to enable scanning of the print substrate 2 in the main scanning direction X. Only four print heads 4*a*-4*d* are depicted for demonstrating the invention. In practice an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black print substrate 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by guiding mechanism 6, 7. These guiding mechanism 6, 7 may be rods as depicted in FIG. 1B.

The rods may be driven by suitable driving mechanism (not shown). Alternatively, the carriage 5 may be guided by other guiding mechanism, such as an arm being able to move the carriage 5. Another alternative is to move the print substrate 2 in the main scanning direction X.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 is arranged in a single linear array parallel to the sub-scanning direction Y. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction X may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*-4*d*. The ink present on the orifice surface 9 may negatively influence the ejection of droplets and the placement of these droplets on the print substrate 2. Therefore, it may be advantageous to remove excess of ink from the orifice surface 9. The excess of ink may be removed for example by wiping with a wiper and/or by application of a suitable anti-wetting property of the surface, e.g. provided by a coating.

Figure 1C:
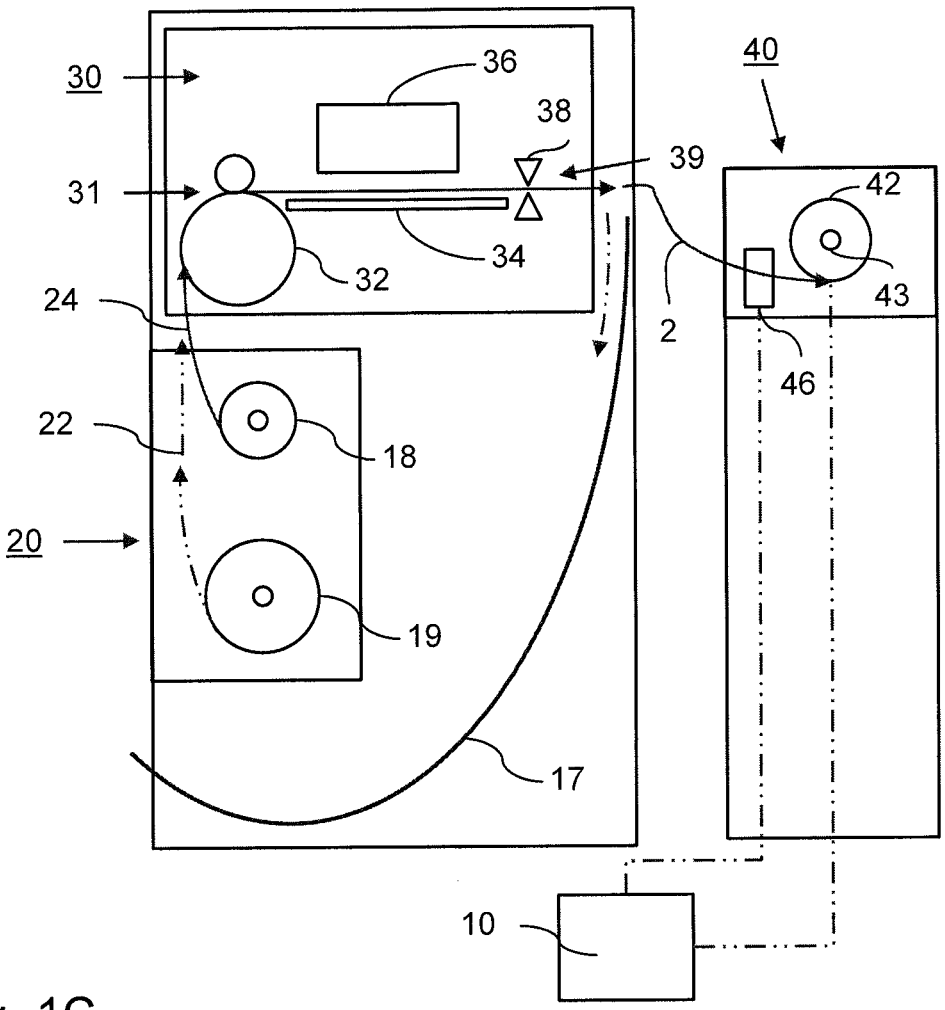
FIG. 1C shows a prior art roll-to-roll printing apparatus.

FIG. 1C shows a prior art roll-to-roll printing apparatus. The printing apparatus comprises an input station 20, a printing station 30, a substrate delivery tray 17 and an output station 40. The input station 20 comprises a roll 18 and a roll 19. The roll 18 may supply a different substrate material or substrate size than the roll 19. For example roll 18 is a 100 g/m$^2$ plain paper having A1 width (841 mm) and 50 meters length and roll 19 is a 200 g/m$^2$ coated vinyl having A0 width (1189 mm) and 100 meters length. Each of the rolls 18, 19 may be fed to the printing station 30 along transport path 22, 24. The printing station comprises a transport nip 32, a printing surface 34, a printing assembly 36 and a cutting device 38. The transport nip 32 is arranged at the entrance side 31 of the printing station 30, while the cutting device 38 is arranged at the exit side 39 of the printing station 30 opposite to the entrance side 31. The substrate delivery tray 17 is arranged below the printing station 30. The output station 40 comprises a roll-up unit 42, a frame 44 and a web detector 46. The roll-up unit 42 comprises a spindle 43, which is rotatably driven by control unit 10. The roll-up unit 42 is supported by the frame 44. The print substrate 2 which leaves the printing station 30 at the exit side 39 is guided to the roll-up unit 42. The roll-up unit 42 automatically winds the print substrate 2 around the spindle 43 controlled by the control unit 10. The control unit 10 receives a signal from the web detector 46, indicating a position of the print substrate 2. The detected position of the print substrate 2 provides an indication of the web tension of the print substrate 2 between the exit side 39 of the printing station 30 and the roll-up unit 42. The winding of the print substrate 2 on the roll-up unit 42 is controlled by the control unit 10 such that the web tension is controlled.

Figure 2A:
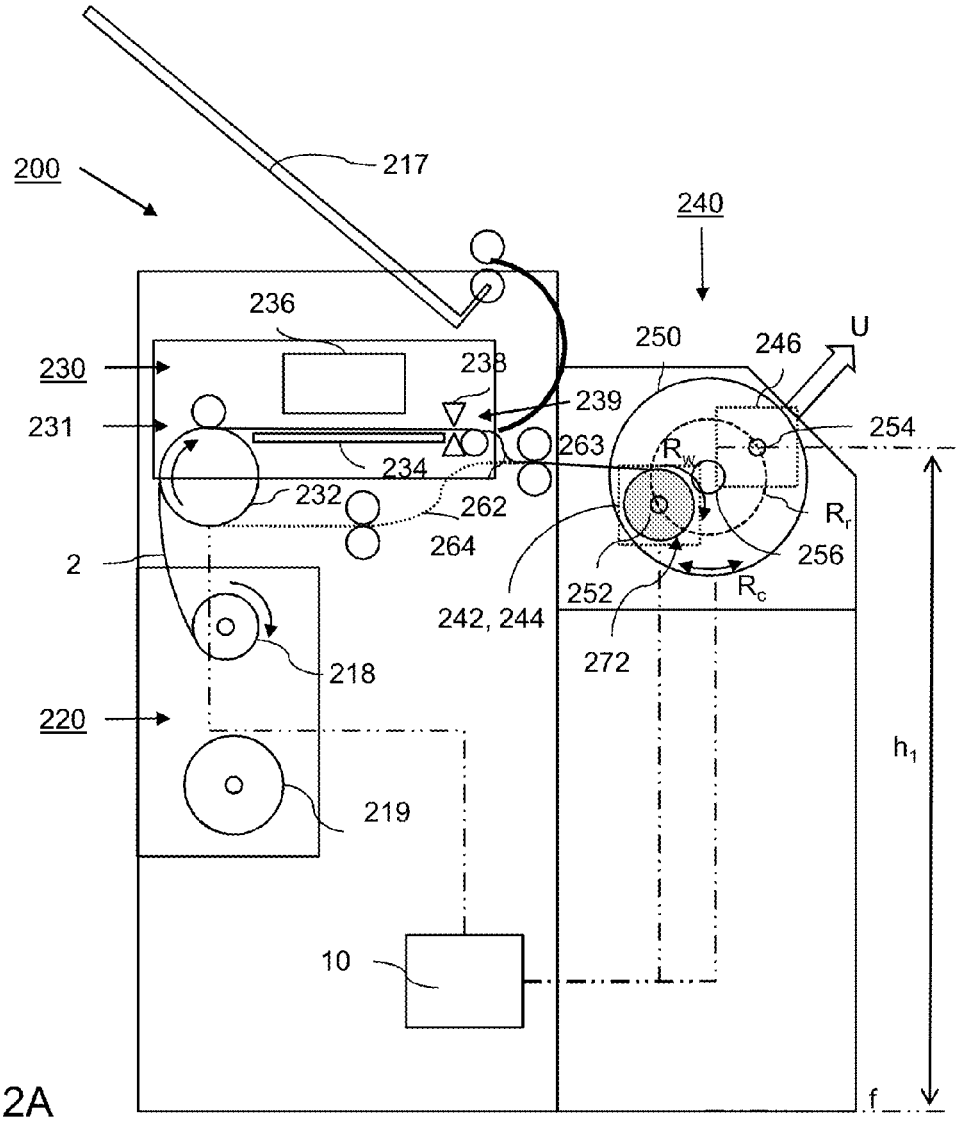
FIGS. 2A-2C schematically show a method according to an embodiment of the invention.
Figure 2B:
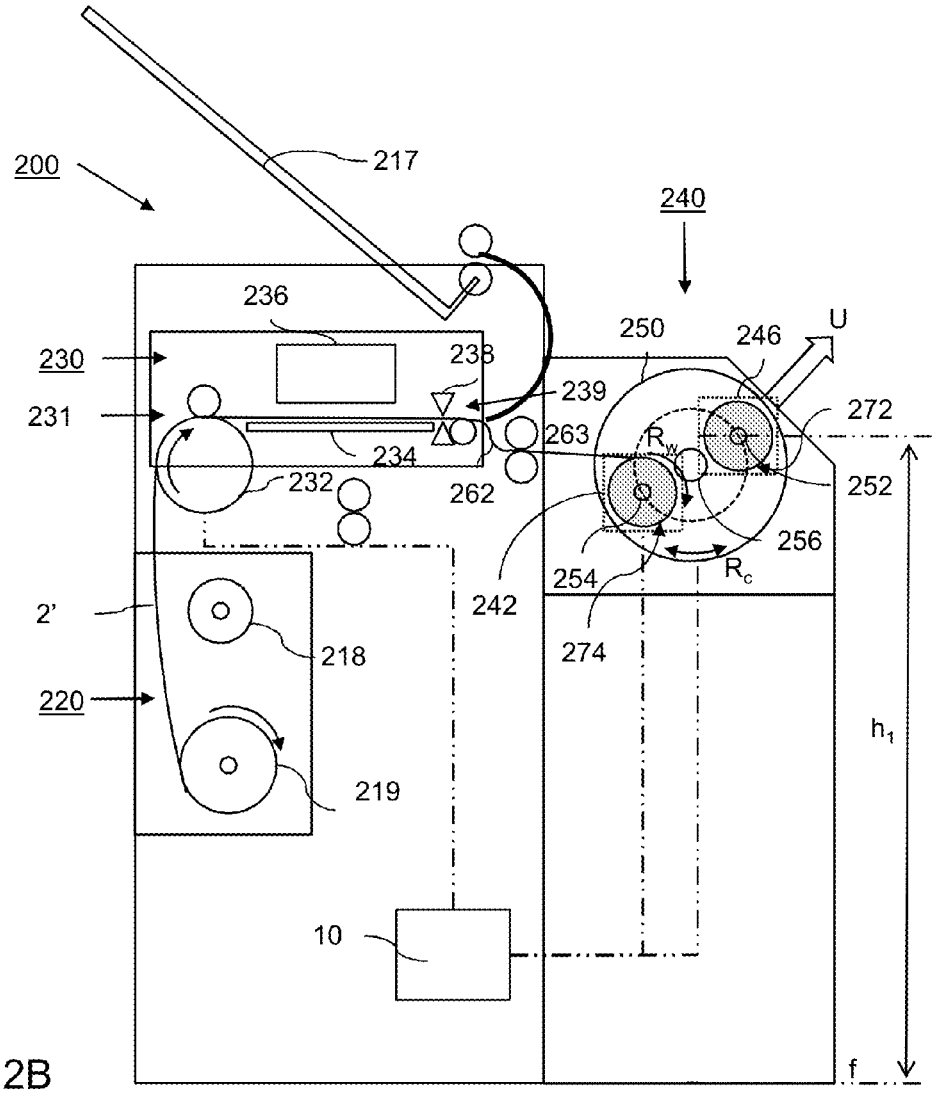
Figure 2C:
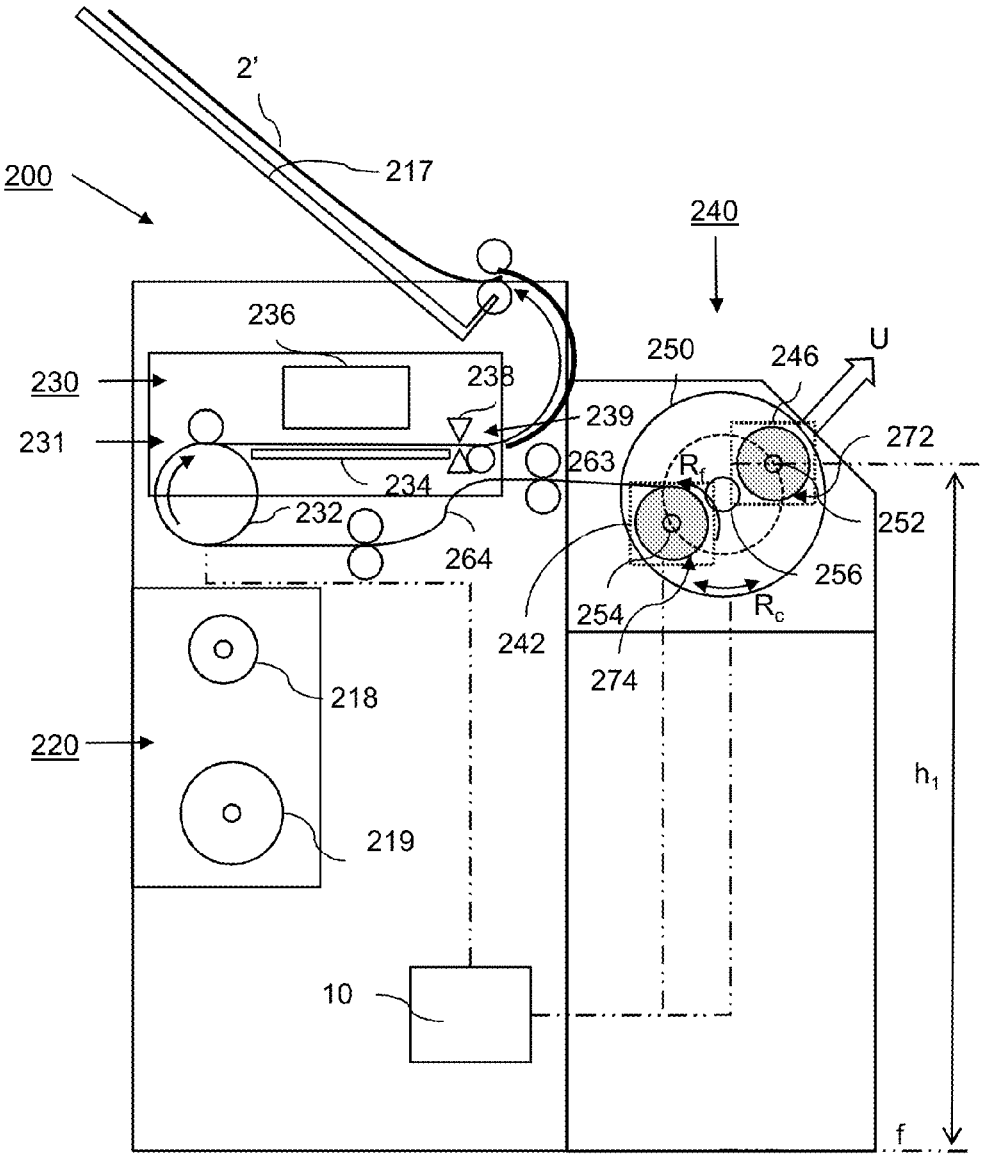

FIGS. 2A-2C schematically show a method according to an embodiment of the invention. The printing apparatus 200 comprises an input station 220, a printing station 230, a substrate delivery tray 217, an output station 240 and a control unit 10. The input station comprises a roll 218 and a roll 219. The roll 218 may supply a different substrate material or substrate size than the roll 219. The printing station comprises a transport nip 232, a printing surface 234, a printing assembly 236 and a cutting device 238. The transport nip 232 is arranged at the entrance side 231 of the printing station 230, while the cutting device 238 is arranged at the exit side 239 of the printing station 230 opposite to the entrance side 231. The substrate delivery tray 217 is arranged above the printing station 230. Further a substrate guiding element 260 is arranged at the exit side 39 of the printing station 230 for selectively directing the printing substrate 2 to one of the substrate delivery tray 217 and the output station 240. The output station 240 comprises a carrousel 250, a substrate receiving position 242, a substrate feeding position 244 and a roll unloading position 246. The substrate receiving position 242 is in this embodiment the same in location as the substrate feeding position 244 (indicated by the same box). The roll unloading position 246 is located at an outer side of the output station 240 at the back of the printing apparatus 200 and is arranged at a height $h_1$ above the floor f. The height $h_1$ is suitably selected for easy and ergonomically manual unloading of a roll by an operator. The carrousel 250 comprises a first roll-up unit 252, a second roll-up unit 254 and an axis 256. Each of the first and second roll-up unit 252, 254 is connected to the carrousel. Each of the roll-up units 252, 254 comprises a spindle. The carrousel 250 is rotatable around the axis 256. The control unit 10 controls the rotational position of the carrousel 250 (as indicated by a dash line). By rotating the carrousel 250 in the direction $R_c$ each of the roll-up units 252, 254 is rotated around the axis 256 along the path $R_r$. The printing apparatus further comprises a first transport path 262 for feeding the print substrate from the exit side 239 of the print station 230 to the substrate receiving position 242 of the output station 240 and a second transport path 264 for feeding the print substrate from the substrate feeding position 244 of the output station 240 to the entrance side 231 of the print station 230. The first transport path 262 and the second transport path 264 have a collective portion 263, which is arranged adjoining to the output station 240. A second substrate guiding element 266 is arranged at a first end of the collective portion 263 and is configured for selectively directing the printing substrate 2 to one of the output station 240 when arriving from the printing station 230 and to the entrance side 231 of the printing station 230 when arriving from the output station 240.

In FIG. 2A a first step of the method is shown, wherein the print substrate 2 is unwind from roll 218 and fed to the entrance side 231 of the print station 230. The print substrate is stepwise transported by the transport nip 232 over the printing surface 234 along the printing assembly 236. The printing assembly is reciprocately moved over the width of the printing substrate 2 in order to provide a first image on a first side of the printing substrate 2. At the exit side 239 the printing substrate 2 is directed by substrate guiding element 260 to the output station 240. The print substrate 2 is transported through the first transport path 262 to the substrate receiving position 242 of the output station 240. Before the first step the first roll-up unit 252 is arranged in the substrate receiving position 242 and the second roll-up unit 254 is arranged in the roll unloading position 246 by rotating the carrousel 250. The roll-up unit 252 receives a leading edge of the print substrate and winds the print substrate 2 around its spindle by rotating the spindle of the roll-up unit 252 in the direction $R_w$. The rotational movement of the spindle of each roll-up unit 252, 254 is controlled by control unit 10. As a result of the winding in the rotation direction $R_w$ the first side and the second side of the print substrate are mutually turned in case the print substrate is fed at later stage (see FIG. 2C) to the entrance side 231 of the print station 230. A trailing edge of the substrate 2 may be formed by cutting the print substrate 2 by the cutting device 38 after the first image has been printed on the first side of the print substrate 2. By winding the print substrate 2 around the spindle of roll-up unit 252 a roll 272 is formed on the roll-up unit 252, bearing the first image.

In FIG. 2B an optional second step is shown, wherein the carrousel 250 is rotated around axis 256 by control unit 10 in order to position the first roll-up unit 252 in the roll-unloading position 246 and to position the second roll-up unit 254 in the substrate receiving position 242. Subsequently a print substrate 2', for example having a different material type such as vinyl, is unwind from roll 219 and fed to the entrance side 231 of the print station 230. On the print substrate 2' a first image is provided on a first side of the printing substrate 2'. The printing substrate 2' is directed to the output station 240 and is received on the second roll-up unit 254 by rotating the spindle in the direction $R_w$, thereby forming a roll 274, bearing the first image. At the same time as printing on the print substrate 2' and forming a roll 274 in the substrate receiving position 242, the roll 272 may be manually unloaded from the output station 240 at the roll unloading position 246 as indicated by arrow U. The printing process is not interrupted during unloading of the roll 272.

In FIG. 2C a third step of the method is shown, wherein the roll 274 is unwind from the spindle of the roll-up unit 254 in the substrate feeding position 244 as indicated by arrow $R_f$. As the substrate feeding position 244 is the same as the substrate receiving position 242 the carrousel does not have to be rotated before starting the third step of the method. The trailing edge of the print substrate 2' during the first step in FIG. 2A has now become the leading edge of the print substrate 2'. The print substrate 2' is transported through the second transport path 264 towards the entrance side 231 of the printing station 230. In the printing station 230 a second image is provided on the second side of the print substrate 2'. At the exit side 239 the print substrate 2' is directed towards the delivery tray 217 to be received in the delivery tray 217.

Figure 3A:
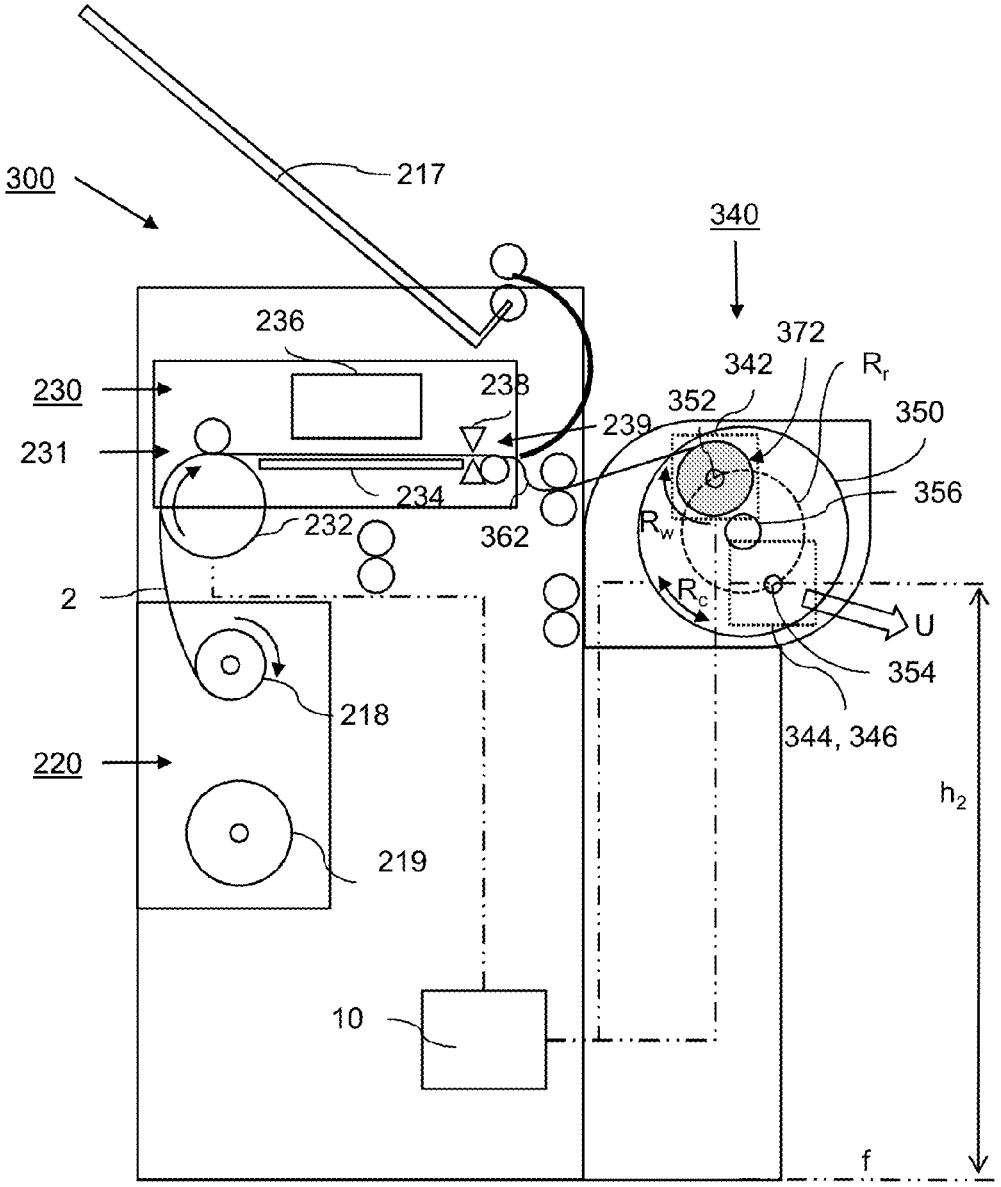
FIGS. 3A-3B schematically show a method according to a second embodiment of the invention.
Figure 3B:
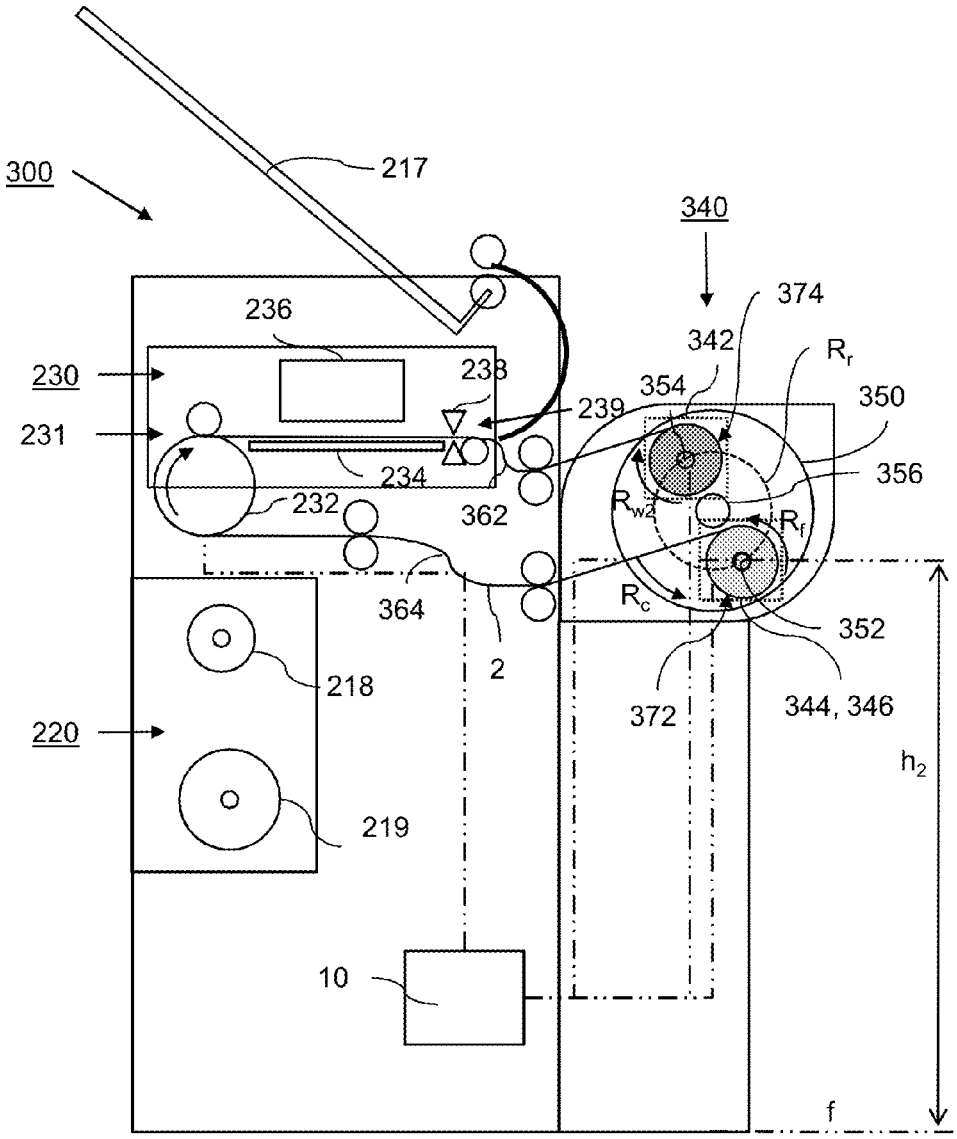

FIGS. 3A-3B schematically show a method according to a second embodiment of the invention. The printing apparatus 300 comprises an input station 220, a printing station 230, a substrate delivery tray 217, an output station 340 and a control unit 10. The input station comprises a roll 218 and a roll 219. The input station 220 and the printing station 230 are similar to the ones shown in FIG. 2A.

The output station 340 comprises a carrousel 350, a substrate receiving position 342, a substrate feeding position 344 and a roll unloading position 346. The substrate receiving position 342 is in this embodiment different in location from the substrate feeding position 344 (both are indicated by a box). The roll unloading position 346 is located at an outer side of the output station 340 at the back of the printing apparatus 300 and is arranged at a height $h_2$ above the floor f. The height $h_2$ is suitably selected for easy and ergonomically manual unloading of a roll by an operator. The roll unloading position 346 is the same in location as the substrate feeding position 344 (indicated by the same box).

The carrousel 350 comprises a first roll-up unit 352, a second roll-up unit 354 and an axis 356. Each of the first and second roll-up unit 352, 354 is connected to the carrousel. Each of the roll-up units 352, 354 comprises a spindle. The carrousel 350 is rotatable around the axis 356. The control unit 10 controls the rotational position of the carrousel 350 (as indicated by a dash line). By rotating the carrousel 350 in the direction $R_c$ each of the roll-up units 352, 354 is rotated around the axis 356 along the path $R_r$. The printing apparatus further comprises a first transport path 362 for feeding the print substrate from the exit side 239 of the print station 230 to the substrate receiving position 342 of the output station 340 and a second transport path 364 for feeding the print substrate from the substrate feeding position 344 of the output station 340 to the entrance side 231 of the print station 230. The first transport path 362 and the second transport path 264 in this embodiment do not have any overlap.

In FIG. 3A a first step of the method is shown, wherein the print substrate 2 is unwind from roll 218 and fed to the entrance side 231 of the print station 230. In the print station a first image is provided on a first side of the printing substrate 2. At the exit side 239 the printing substrate 2 is directed by substrate guiding element 260 to the output station 340. The print substrate 2 is transported through the first transport path 362 to the substrate receiving position 342 of the output station 340. Before the first step the first roll-up unit 352 is arranged in the substrate receiving position and the second roll-up unit 354 is arranged in the roll unloading position 246 by rotating the carrousel 350. The roll-up unit 352 receives a leading edge of the print substrate and winds the print substrate 2 around its spindle by rotating the spindle in the direction $R_w$. The rotation direction $R_w$ is suitably selected in order that the first image is arranged on the inside or on the outside of the roll-up unit. The rotational movement of the spindle of each roll-up unit 352, 354 is controlled by control unit 10. A trailing edge of the substrate 2 may be formed by cutting the print substrate 2 by the cutting device 238 after the first image has been printed on the first side of the print substrate 2. By winding the print substrate 2 around the spindle of roll-up unit 352 a roll 372 is formed on the roll-up unit 352, bearing the first image. During the first step any roll which may be available on the roll-up unit 354 can be unloaded from the output station 340 in the roll unloading position 346 as indicated by arrow U.

In FIG. 3B a second step and a third step of the method is shown. In the second step the carrousel 340 is rotated around axis 356 in order to position the first roll-up unit 352 in the substrate feeding position 344 and to position the second roll-up unit 354 in the substrate receiving position 342.

In the third step the roll 372 is unwind from the spindle of the first roll-up unit 352 in the substrate feeding position 344 as indicated by arrow $R_f$. The trailing edge of the print substrate 2 during the first step in FIG. 3A has now become the leading edge of the print substrate 2. The print substrate 2 is transported through the second transport path 364 towards the entrance side 231 of the printing station 230. In the printing station 230 a second image is provided on the second side of the print substrate 2. At the exit side 239 the print substrate 2 is directed towards the output station 340 along the first transport path 362. The print substrate 2, bearing the first image on the first side and the second image on the second side, is received on the roll-up unit 354 and winds the print substrate 2 around its spindle by rotating the spindle in the second winding direction $R_{w2}$, thereby forming a roll 374. The second winding direction $R_{w2}$ is freely selectable. The second winding direction $R_{w2}$ may be selected based on any further processing of the roll 374.

Figure 4A:
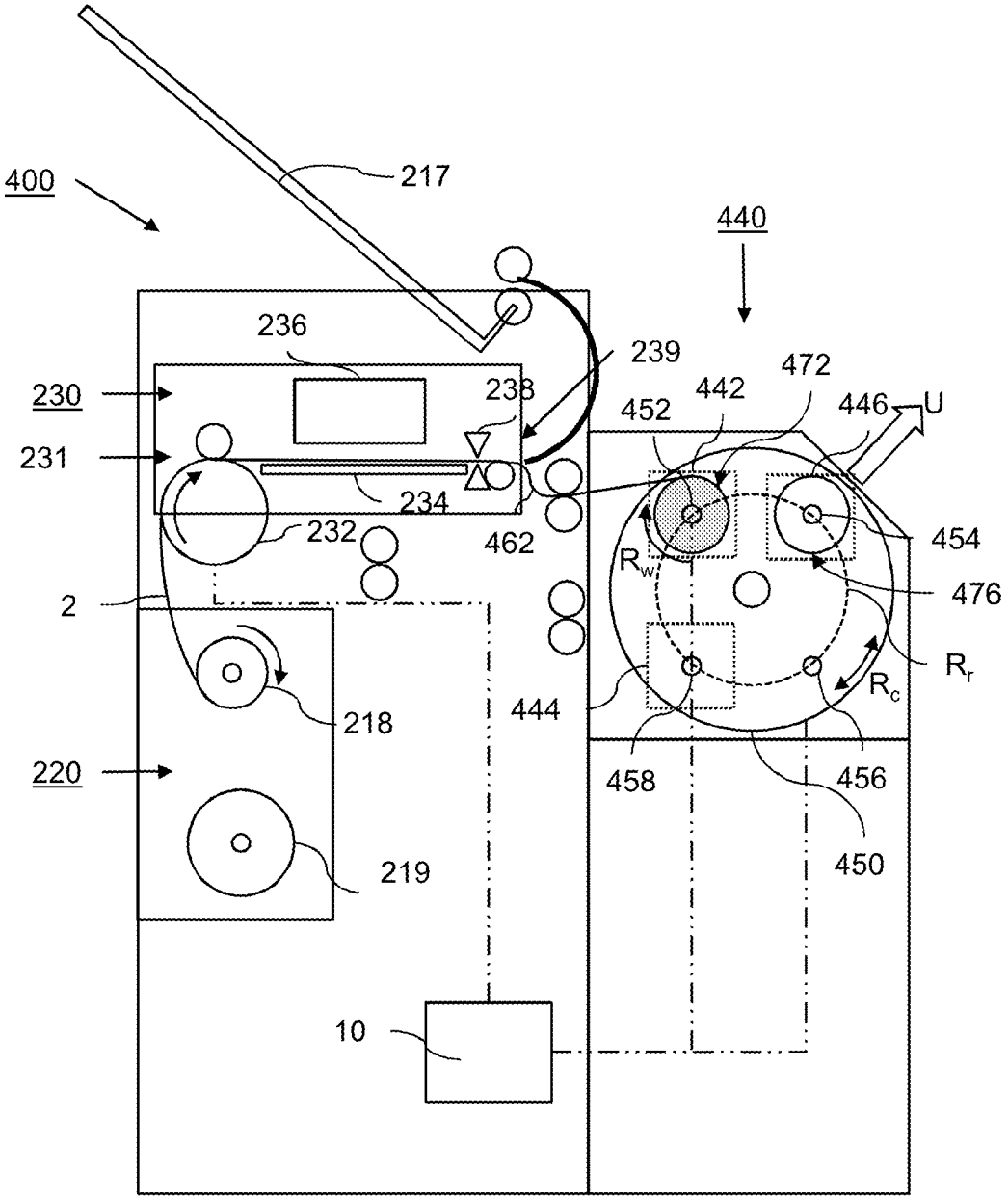
FIGS. 4A-4B schematically show a method according to a third embodiment of the invention.
Figure 4B:
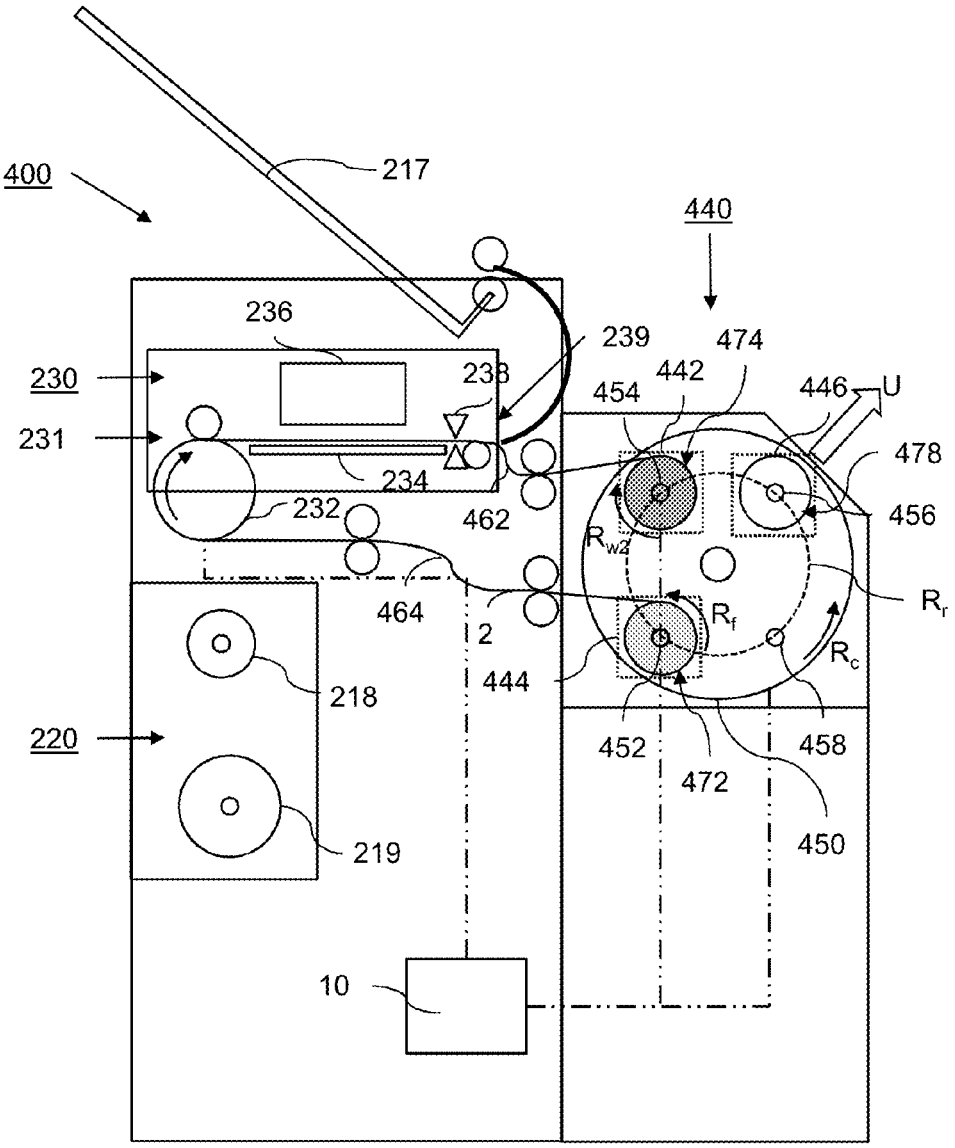

FIGS. 4A-4B schematically show a method according to a third embodiment of the invention. The printing apparatus 400 comprises an input station 220, a printing station 230, a substrate delivery tray 217, an output station 340 and control unit 10. The input station comprises a roll 218 and a roll 219. The input station 220 and the printing station 230 are similar to the ones shown in FIG. 2A.

The output station 440 comprises a carrousel 450, a substrate receiving position 442, a substrate feeding position 444 and a roll unloading position 446. The substrate receiving position 442 is in this embodiment different in location from the substrate feeding position 444 (both are indicated by a box). The roll unloading position 446 is different in location from the substrate feeding position 444 (both are indicated by a box).

The carrousel 450 comprises a first roll-up unit 452, a second roll-up unit 454, a third roll-up unit 456, a fourth roll-up unit 458 and an axis 460. Each of the first, second, third and fourth roll-up units 452, 454, 456, 458 is connected to the carrousel 450. Each of the roll-up units 452, 454, 456, 458 comprises a spindle. The carrousel 450 is rotatable around the axis 460. The control unit 10 controls the rotational position of the carrousel 450 (as indicated by a dash line). By rotating the carrousel 450 in the direction $R_c$ each of the roll-up units 452, 454, 456, 458 is rotated around the axis 460 along the path $R_f$. The printing apparatus further comprises a first transport path 462 for feeding the print substrate from the exit side 239 of the print station 230 to the substrate receiving position 442 of the output station 440 and a second transport path 464 for feeding the print substrate from the substrate feeding position 444 of the output station 440 to the entrance side 231 of the print station 230. The first transport path 462 and the second transport path 464 in this embodiment do not have any overlap.

In FIG. 4A a first step of the method is shown, wherein the print substrate 2 is unwind from roll 218 and fed to the entrance side 231 of the print station 230. In the print station a first image is provided on a first side of the printing substrate 2. At the exit side 239 the printing substrate 2 is directed by substrate guiding element 260 to the output station 440. The print substrate 2 is transported through the first transport path 462 to the substrate receiving position 442 of the output station 440. Before the first step the first roll-up unit 452 is arranged in the substrate receiving position 442 and the second roll-up unit 454 is arranged in the roll unloading position 446 by rotating the carrousel 450. The roll-up unit 452 receives a leading edge of the print substrate and winds the print substrate 2 around its spindle by rotating the spindle in the direction $R_w$. The rotation direction $R_w$ is suitably selected in order that the first image is arranged on the inside or on the outside of the roll-up unit. The rotational movement of the spindle of each roll-up unit 452, 454, 456, 458 is controlled by control unit 10. By winding the print substrate 2 around the spindle of the roll-up unit 452 a roll 472 is formed on the roll-up unit 452, bearing the first image. During the first step any roll 476 which may be available on the second roll-up unit 454 can be unloaded from the output station 440 in the roll unloading position 446 as indicated by arrow U. For example the roll 476 is collected on the second roll-up unit 454 in an earlier simplex or duplex printing process as may be carried out similar to the steps of the embodiment shown in FIG. 4A-4B.

In FIG. 4B a second step and a third step of the method is shown. In the second step the carrousel 440 is rotated around axis 460 in order to position the first roll-up unit 452 in the substrate feeding position 444, to position the second roll-up unit 454 in the substrate receiving position 442 and to position the fourth roll-up unit 458 in the roll unloading position 446.

In the third step the roll 472 is unwind from the spindle of the first roll-up unit 452 in the substrate feeding position 444 as indicated by arrow $R_f$. The trailing edge of the print substrate 2 during the first step in FIG. 3A has now become the leading edge of the print substrate 2. The print substrate 2 is transported through the second transport path 464 towards the entrance side 231 of the printing station 230. In the printing station 230 a second image is provided on the second side of the print substrate 2. At the exit side 239 the print substrate 2 is directed towards the output station 440 along the first transport path 462. The print substrate 2, bearing the first image on the first side and the second image on the second side, is received on the second roll-up unit 454 and winds the print substrate 2 around its spindle by rotating the spindle in the second winding direction $R_{w2}$, thereby forming a roll 474. The second winding direction $R_{w2}$ is freely selectable. During the third step any roll 478 which may be available on a third roll-up unit 456 can be unloaded from the output station 440 in the roll unloading position 446 as indicated by arrow U. For example the roll 478 is collected on the third roll-up unit 456 in an earlier simplex or duplex printing process as may be carried out similar to the steps of the embodiment shown in FIG. 4A-4B.

Figure 5A:
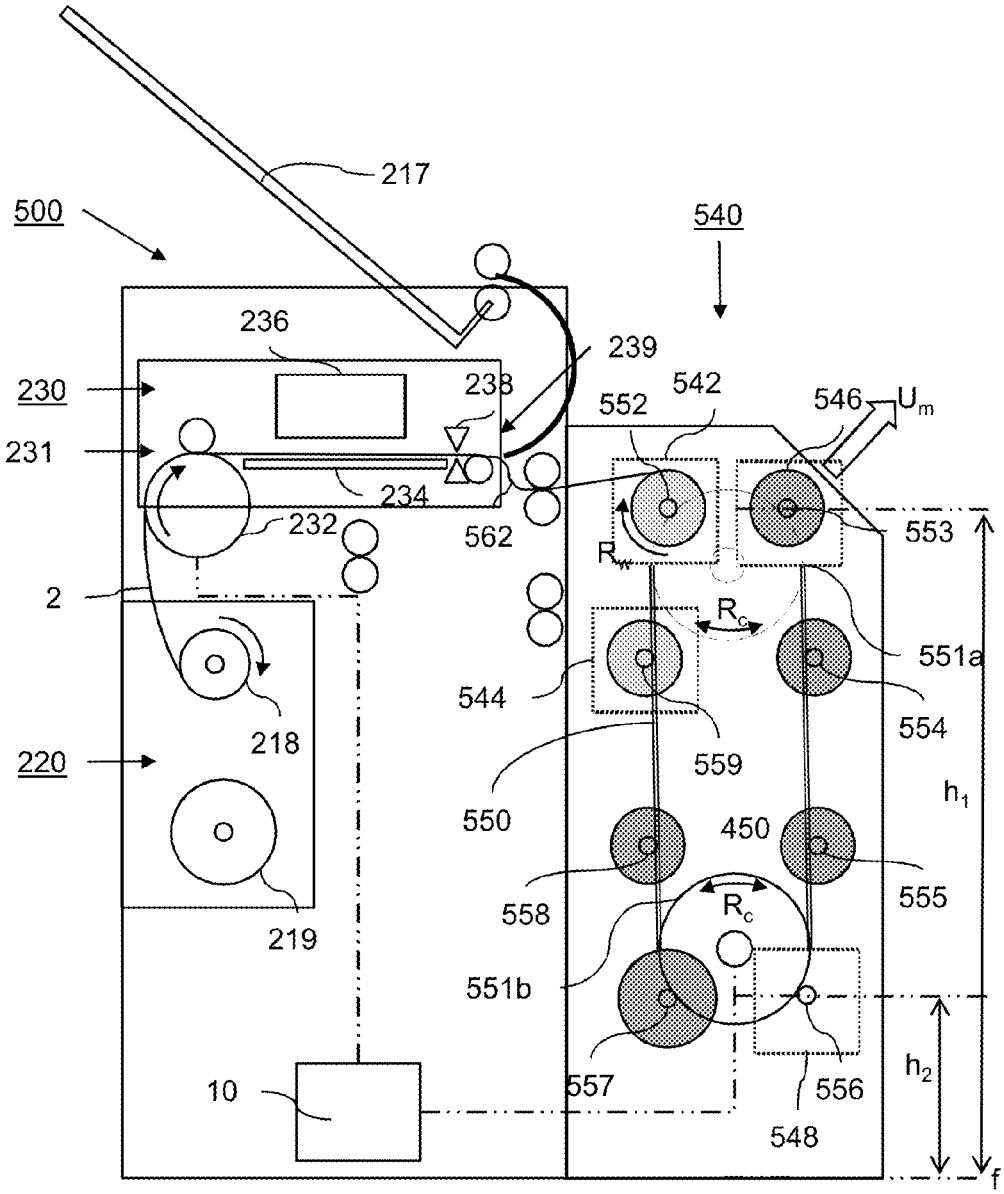
FIGS. 5A-5B schematically illustrate a method according to a fourth embodiment of the invention.
Figure 5B:
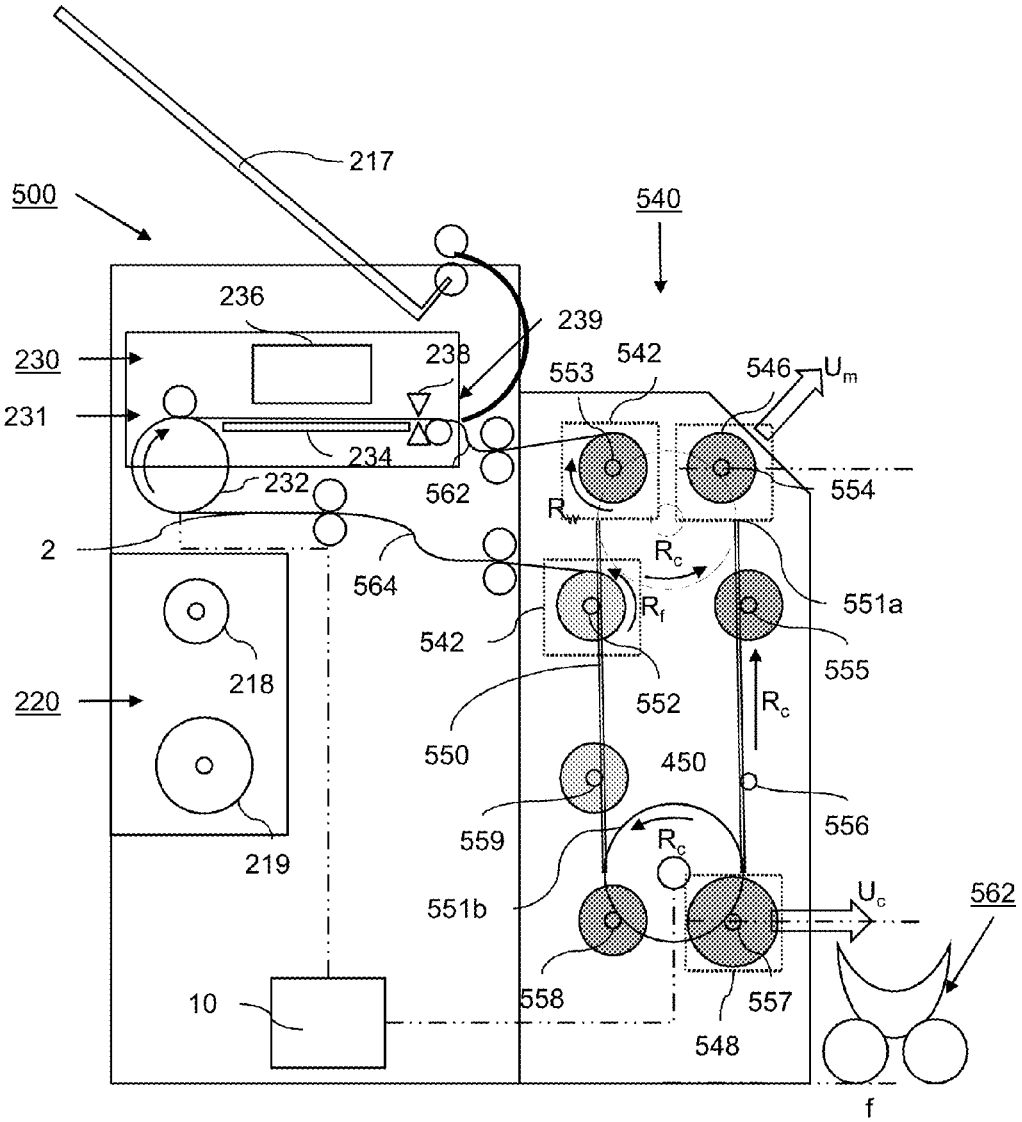

FIGS. 5A-5B schematically illustrate a method according to a fourth embodiment of the invention. The printing apparatus 500 comprises an input station 220, a printing station 230, a substrate delivery tray 217, an output station 540 and a control unit 10. The input station 220 and the printing station 230 are similar to the ones shown in FIG. 2A.

The output station 540 comprises a carrousel 550, a substrate receiving position 542, a substrate feeding position 544, a first roll unloading position 546 and a second roll unloading position 548. The substrate receiving position 542 is different in location from the substrate feeding position 544. The first roll unloading position 546 is different in location from the substrate feeding position 544 and from the second roll unloading position 548 (indicated by boxes). The first roll unloading position 546 is arranged at a height $h_1$ above the floor f and the second roll unloading position 548 is arranged at a height $h_2$ above the floor f, height $h_2$ being different from the height $h_1$. The height $h_1$ is suitably selected for easy and ergonomically manual unloading of a roll by an operator. The height $h_2$ is suitably selected for unloading a roll on a separate carriage. The manual unloading at height $h_1$ is advantageous in case the roll is not too heavy and not too large to be carried manually. The unloading at height $h_2$ on a carriage is advantageous in case the roll is too heavy to handle manually.

The carrousel 550 comprises two driving rollers 551*a*, 551*b* and plurality of roll-up-units 552-559, each being connected to the carrousel and each comprising a spindle (not shown). The driving rollers 551*a*, 551*b* controllably move the carrousel along a predefined path 560, thereby moving the plurality of roll-up-units 552-559. The driving rollers are controlled by control unit 10.

In FIG. 5A a first roll-up unit 552 is arranged in the substrate receiving position 542, a second roll-up unit 553 is arranged in the first unloading position 546, a fifth roll-up unit 556 is arranged in the second unloading position 548 and an eighth roll-up unit 559 is arranged in the substrate feeding position 544.

In FIG. 5A a first step of the method is shown, wherein the print substrate 2 is unwind from roll 218 and fed to the entrance side 231 of the print station 230. In the print station a first image is provided on a first side of the printing substrate 2. At the exit side 239 the printing substrate 2 is directed by substrate guiding element 260 to the output station 540. During the first step any roll which may be available on the second roll-up unit 553 can be manually unloaded from the output station 540 in the first roll unloading position 546 as indicated by arrow $U_m$. Also any roll which may be available on the fifth roll-up unit 556 can be unloaded from the output station 540 on a carriage in the second roll unloading position 548 as indicated by arrow $U_c$. In case the operator indicates an unload procedure to the control unit 10 of the printing apparatus, the control unit may suitably arrange any roll in the first unloading position 546 or the second unloading position 548 based upon knowledge of the size and weight of the roll which is to be unloaded from any of the roll-up units 552-559. For example in FIG. 5A the roll on the second roll-up unit 553 is small and with little weight and may be unloaded manually. The roll on the sixth roll-up unit 557 is large and heavy and needs to be unloaded by carriage. In FIG. 5A the operator takes out the roll from the second roll-up unit 553, while the printing apparatus receives a simplex print on the first roll-up unit 552. The printing apparatus may indicate to the operator an unloading period, wherein the roll may be unloaded from the unloading position before the carrousel is controlled to be moved by the control unit 10. In this way the operator is supported not to interrupt the printing process for duplex printing and/or multiple print jobs.

In FIG. 5B a second step and a third step of the method is shown. In the second step the carrousel 540 is moved by driving rollers 551*a*, 551*b* in the direction $R_c$ in order to position the first roll-up unit 552 in the substrate feeding position 544, to position the second roll-up unit 553 in the substrate receiving position 542 and to position the sixth roll-up unit 557 in the second roll unloading position 548. In the third step the roll in the substrate feeding position 544 is unwind and fed to the printing station 230 in order to print a second image on the second side and subsequently transported to the substrate receiving position 542 in order to form a roll on the second roll-up unit 553. During the third step the roll which is available on the sixth roll-up unit 557 can be unloaded from the output station 540 on a carriage 562 in the second roll unloading position 548 as indicated by arrow $U_c$.

Figure 6A:
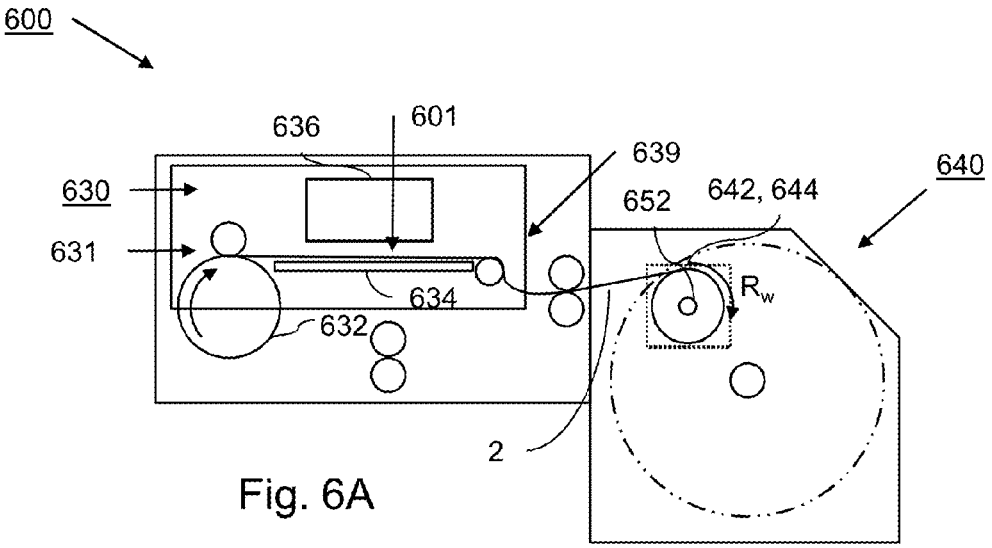
FIGS. 6A-6B schematically show an example of a substrate turning mechanism according to the invention.
Figure 6B:
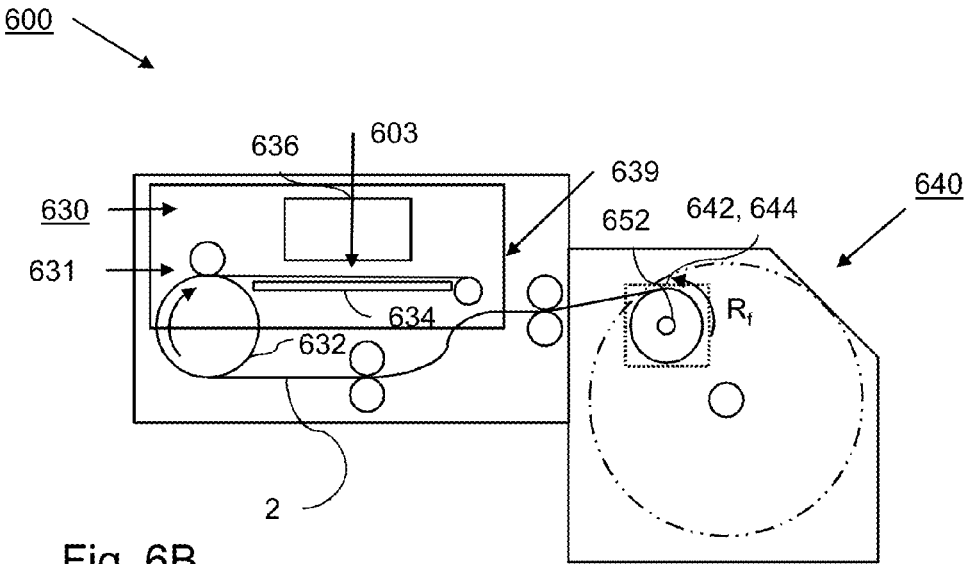

FIGS. 6A-6B schematically show an example of a substrate turning mechanism according to the invention. A printing apparatus 600 comprises a printing station 630, an output station 640 and a control unit (not shown). The printing station 630 comprises a transport nip 632, a printing surface 634 and a printing assembly 636. The transport nip 632 is arranged at the entrance side 631 of the printing station 630; the exit side 639 of the printing station 630 is at the opposite side to the entrance side 631. The printing assembly 636 faces the printing surface 634 at one side of the printing surface 634.

In FIG. 6A in a first part of a circulating movement the print substrate 2 is moved through the print station, wherein a first image is printed on a first side 601 in the print station 630, and is transported from the exit side 639 of the print station 630 to a roll-up unit 652 of the output station 640. The roll-up unit 652 receives a leading edge of the print substrate and winds the print substrate 2 by rotating the leading edge of the print substrate 2 in the direction $R_w$. As a result the first side and the second side of the print substrate are mutually turned in case the print substrate is fed at later stage to the entrance side 631 of the print station 630. By winding the print substrate 2 a roll 672 is formed on the roll-up unit 652, bearing the first image.

In FIG. 6B a second part of the circulating movement is shown, wherein the roll 672 is unwind from the roll-up unit 652 as indicated by arrow $R_f$ and is fed to the entrance side 631 of the print station 630. The trailing edge of the print substrate 2 during the first part has now become the leading edge of the print substrate 2. During transport of the print substrate 2 through the printing station 630 the second side 603 of the print substrate now faces the printing assembly 236 and a second image may be provided on the second side of the print substrate 2.

Figure 7A:
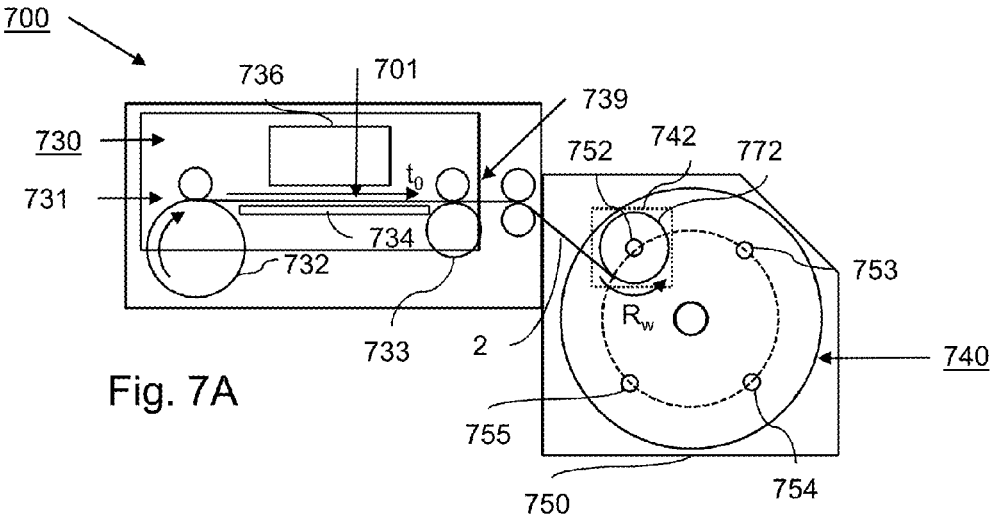
FIGS. 7A-7C schematically show a second example of a substrate turning mechanism according to the invention.
Figure 7B:
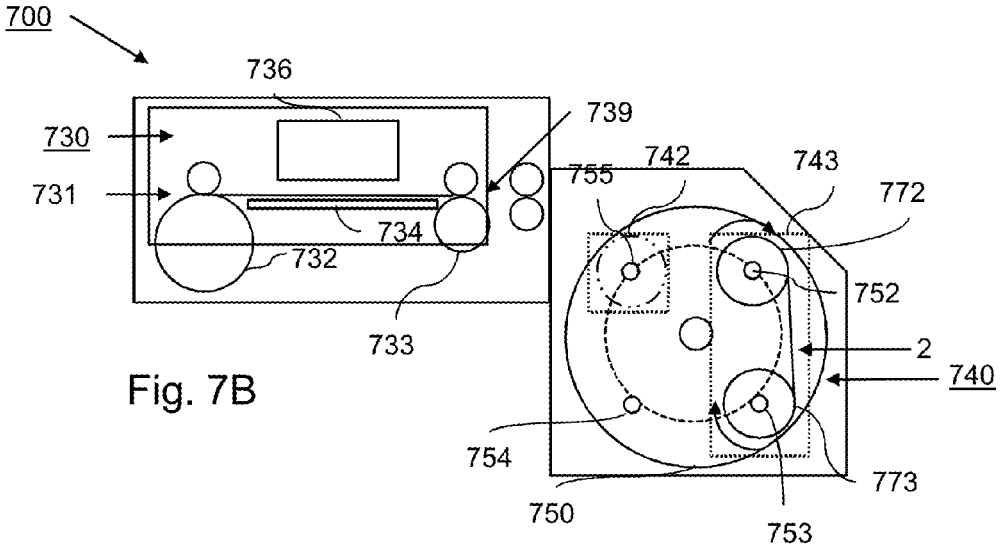
Figure 7C:
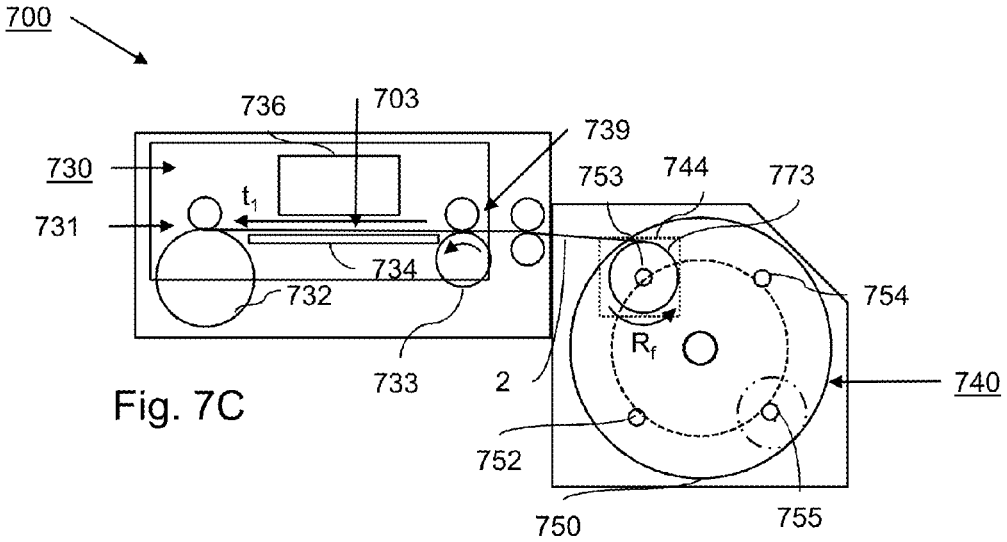

FIGS. 7A-7C schematically show a second example of a substrate turning mechanism according to the invention wherein the print substrate is circulated from the exit side of the print station back to the exit side of the print station. A printing apparatus 700 comprises a printing station 730, an output station 740 and a control unit (not shown). The printing station 730 comprises a first transport nip 732, a second transport nip 733, a printing surface 734 and a printing assembly 736. The first transport nip 732 is arranged at the first entrance side 731 of the printing station 730. The second transport nip 733 is arranged at the exit side 739 of the printing station 730, which is at the opposite side to the entrance side 731. The printing assembly 736 faces the printing surface 734 at one side of the printing surface 734. The output station 740 comprises a carrousel 750, which comprises four roll-up units 752-755.

In FIG. 7A in a first part of a circulating movement the print substrate 2 is moved through the print station by first transport nip 732 in a direction to, wherein a first image is printed on a first side 701 in the print station 730, and is transported from the exit side 739 of the print station 730 to a roll-up unit 752 of the output station 740. The roll-up unit 752 receives a leading edge of the print substrate and winds the print substrate 2 by rotating the leading edge of the print substrate 2 in the direction $R_w$. As a result the first side and the second side of the print substrate are mutually turned. By winding the print substrate 2 a roll 772 is formed on the roll-up unit 752, bearing the first image.

In FIG. 7B the carrousel 750 is rotated in the direction $R_c$, thereby arranging the first roll-up unit 752 to a roll-to-roll turn position 743. In the roll-to-roll turning position 743 the print substrate 2 is unwind from the roll-up unit 752 and fed to the second roll-up unit 753. The print substrate 2 is received on the second roll-up unit 753 and wind, thereby forming a roll 773. As a result the leading edge and the trailing edge are mutually changed and the first side 601 and the second side 603 are mutually changed. Optionally during the roll-to-roll turning step another print substrate is transported through the print station 730 and received on the roll-up unit 755 in the substrate receiving position 742.

In FIG. 7C the carrousel 750 is rotated, thereby arranging the second roll-up unit 753 in the substrate feeding position 744 (in this example the same as the substrate receiving position 742). Furthermore a second part of the circulating movement is shown, wherein the roll 773 is unwind from the second roll-up unit 753 as indicated by arrow $R_f$ and is fed to the exit side 739 of the print station 630.

The leading edge of the print substrate 2 during the first part has now become the leading edge of the print substrate 2. During transport of the print substrate 2 through the printing station 730 in a direction $t_1$ the second side 703 of the print substrate now faces the printing assembly 736 and a second image may be provided on the second side of the print substrate 2.

A person skilled in the art may easily contemplate other ways of turning a printing substrate in the duplex printing apparatus based on prior art knowledge, such as turning the print substrate when retained as a roll in a roll-up unit by rotating the roll-up unit in a direction perpendicular to the axis of the roll-up unit. The turning step may be incorporated in the carrousel mechanism. For example by turning the roll-up unit from the substrate receiving position to the substrate feeding position the roll-up unit may be guided along a turning path, for example by chains which are connected to both ends of the roll-up unit.

Figure 8A:
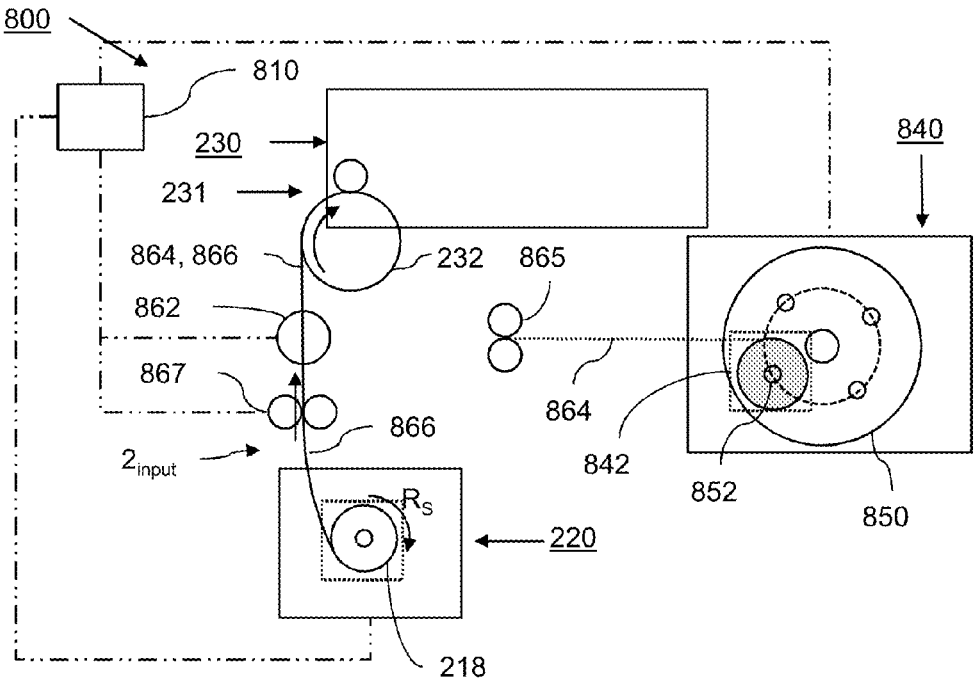
FIGS. 8A-8B schematically show a first and a second state of an input control mechanism according to the invention.
Figure 8B:
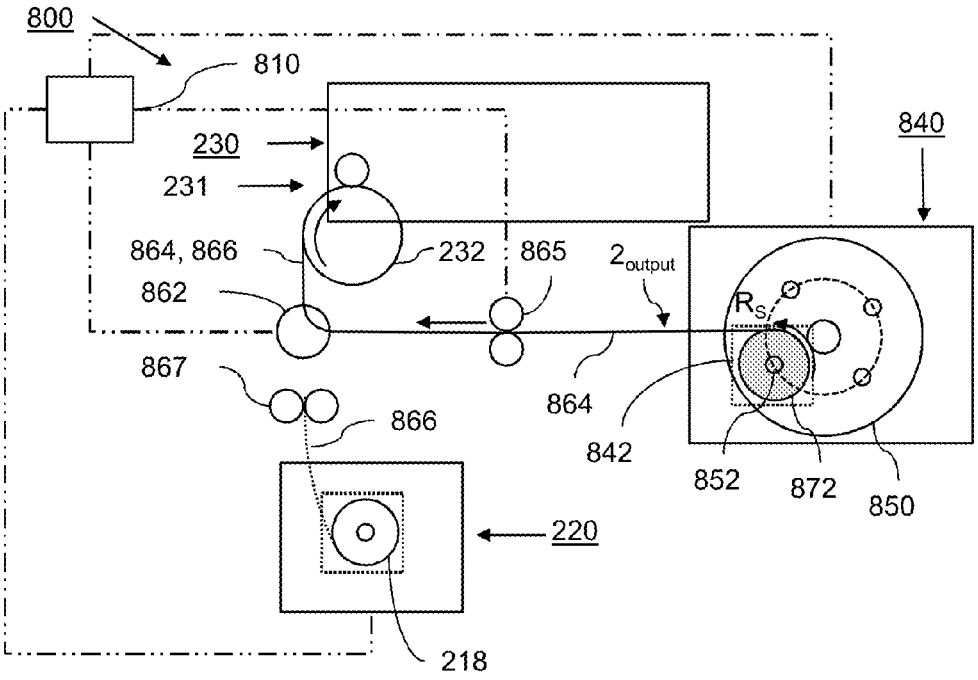

FIGS. 8A-8B schematically show a first and a second state of an input control mechanism according to the invention. A printing apparatus 800 comprises an input station 220, a printing station 230, an output station 840 and an input control mechanism 810. The input control mechanism 810 may in an embodiment comprise a part of the control unit 10. The printing station 230 comprises a transport nip 232 arranged at an entrance side 231 of the printing station 230. The output station 840 comprises a carrousel 850 according to the present invention.

The printing apparatus further comprises a feeding path switch 862. The feeding path switch 862 is arranged at a feeding path joining position, where an input transport path 866, which comes from the input station 220, and a second transport path 864, which comes from the output station 840, join together. The input transport path 866 is arranged for feeding the print substrate 2 from the input station 220 to the printing station 230. The second transport path 864 is arranged for feeding the print substrate 2 from the substrate feeding position 852 of the output station 840 to the printing station 230. The input transport path 866 and the second transport path 864 have a collective portion 864, 866 arranged between the feed path joining position of the feeding path switch 862 and the entrance 231 of the printing station 230.

The feeding path switch 862 may be a valve or may be a control gate. The control gate may be angularly movable with respect to a rotatable shaft. The control gate may comprise one or more vanes, each vane adapted for providing a passageway for the print substrate. The vane may optionally being curved to deflect the print substrate 2 through an appreciable angle in the transport path towards the printing station 230.

In FIG. 8A a first state of the input control mechanism 810 is shown wherein the input station 220 is selected as the input source for supplying the print substrate $\mathbf{2}_{input}$ towards the printing station 230. The first state may be selected based on a printing mode of a first pass for providing a first image on a first side of the print substrate 2. The input control mechanism 810 controls the unwinding of the roll 218 from the spindle of the input station 220 as indicated by arrow $R_s$.

The input control mechanism 810 controls driving nips 867 of the input transport path 866 for feeding the print substrate $\mathbf{2}_{input}$ from the input station 220 towards the feeding path switch 862. The input control mechanism 810 has moved the feeding path switch 862 in a first state, which is adapted to guide the print substrate $\mathbf{2}_{input}$ at the feeding path joining position towards the printing station 230. In the first state the print substrate $\mathbf{2}_{input}$ is fed from the input station 220 to the printing station 230.

In FIG. 8B a second state of the input control mechanism 810 is shown wherein the output station 840 is selected as the input source for supplying the print substrate $\mathbf{2}_{output}$ towards the printing station 230. The second state may be selected based on a printing mode of a second pass for providing a second image on a second side of the print substrate 2. The input control mechanism 810 controls the unwinding of the roll 872 from the spindle of the roll-up unit 852, which is arranged in the substrate feeding position 842, as indicated by arrow $R_s$. The input control mechanism 810 further controls driving nips 865 of the second transport path 864 for feeding the print substrate 2 towards the feeding path switch 862. The input control mechanism 810 has moved the feeding path switch 862 in a second state, which is adapted to guide the print substrate $\mathbf{2}_{output}$ at the feeding path joining position towards the printing station 230. In the second state the print substrate $\mathbf{2}_{output}$ is fed from the output station 840 to the printing station 230.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims is herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A printing apparatus for printing on a print substrate, comprising:

a printing station comprising a printing assembly for printing a first image on a first side of the print substrate during a first pass of the print substrate and printing a second image on a second side of the print substrate during a second pass of the print substrate;

an input station for supplying the print substrate to the printing station, the input station comprising at least one roll unit for supplying a print substrate;

an output station for receiving the print substrate from the printing station, the output station comprising:

a carrousel, the carrousel comprising at least two roll-up units, the carrousel being movable in a plurality of positions, in each of which a first roll-up unit of the at least two roll-up units is arranged in a substrate receiving position and a second roll-up unit of the at least two roll-up units is arranged in a position of the group of a substrate feeding position and a roll unloading position, wherein the roll-up unit in the substrate receiving position is adapted for receiving the print substrate, thereby forming a roll, and wherein the roll unloading position is different in location from the substrate receiving position;

the input station being arranged remote from the output station;

the printing apparatus further comprising an input control mechanism adapted for selecting an input source for supplying the print substrate towards the printing station from one of the input station and the output station.

2. The printing apparatus according to claim 1, wherein the printing apparatus comprises a feeding path switch adapted for guiding the print substrate from the selected input source to the printing station, the feeding path switch being in operation movable in one of a first state for selectively guiding a print substrate provided from the input station and a second state for selectively guiding a print substrate provided from the output station.

3. The printing apparatus according to claim 1, wherein the input control mechanism is adapted to select the input source in response to a simplex printing mode or a duplex printing mode.

4. The printing apparatus according to claim 1, wherein the substrate feeding position is the same in location as the substrate receiving position, and wherein in each position of the carrousel said second roll-up unit of the at least two roll-up units is arranged in the roll unloading position.

5. The printing apparatus according to claim 1, wherein the substrate feeding position is different in location from the substrate receiving position.

6. The printing apparatus according to claim 5, wherein the roll unloading position is the same in location as the substrate feeding position.

7. The printing apparatus according to claim 5, wherein the roll unloading position is different in location from the substrate feeding position, and wherein the carrousel supports at least three roll-units, wherein in each of position of the carrousel a third roll-up unit of the at least three roll-up units is arranged in the roll unloading position.

8. The printing apparatus according to claim 1, wherein each roll-up unit comprises a spindle and the carrousel comprises for each roll-up unit:

a winding mechanism for winding the print substrate around the spindle in order to form the roll;

an unwinding mechanism for unwinding the print substrate from the spindle; and a retaining mechanism adapted to retain the free end of the roll of print substrate in a fixed position with respect to the spindle.

9. The printing apparatus according to claim 1, wherein the carrousel is rotatable about an axis and wherein the plurality of positions of each of the roll-up units is arranged along a circular path.

10. A method for operating a printing apparatus, the printing apparatus comprising: a printing station, an input station and an output station, the printing station comprising a printing assembly, wherein the output station comprises a carrousel, the carrousel being movable in a plurality of positions, the carrousel comprising at least two roll-up units, the method comprising the steps of:

selecting one of the input station and the output station as the supply source and supplying a print substrate from the selected supply source to the printing station;

providing a first image on a first side of the print substrate in the printing station;

arranging the carrousel in one position of the plurality of positions, in which position a first roll-up unit of the at least two roll-up units is arranged in a substrate receiving position and a second roll-up unit of the at least two roll-up units is arranged in one position of the group of a substrate feeding position and a roll unloading position, wherein the roll unloading position is different in location from the substrate receiving position;

receiving the print substrate, bearing the first image, on the first roll-up unit of the at least two roll-up units, which is arranged in the substrate receiving position, thereby forming a roll;

unwinding the roll from the first roll-up unit of the at least two roll-up units, which is arranged in the substrate feeding position, and feeding the print substrate to the printing station; and providing a second image on a second side of the print substrate in the printing station.

11. The method according to claim 10, wherein the substrate feeding position during the unwinding and feeding step of the print substrate is the same in location as the substrate receiving position during the receiving step of the print substrate, and wherein in the carrousel arranging step the second roll-up unit of the at least two roll-up units is arranged in the roll unloading position.

12. The method according to claim 10, wherein the substrate feeding position of the roll-up unit during the unwinding and feeding step of the print substrate is different in location from the substrate receiving position during the receiving step of the print substrate, and the method further comprises the step of:

arranging the carrousel in one position of the plurality of positions, in which position the first roll-up unit of the at least two roll-up units is arranged in the substrate feeding position and the second roll-up unit of the at least two roll-up units is arranged in the substrate receiving position;

wherein the second carrousel arranging step is carried out after the receiving step of the print substrate and before the unwinding and feeding step of the print substrate.

13. The method according to claim 12, wherein the method further comprises the step of:

receiving the print substrate, bearing the first image and the second image, on the second roll-up unit of the at least two roll-up units in the substrate receiving position thereby forming a roll;

wherein the second receiving step of the print substrate is carried out after the step of providing a second image on the second side of the print substrate.

14. The method according to claim 12, wherein further the roll unloading position is different in location from the substrate feeding position and the carrousel supports at least three roll-up units and wherein in the second carrousel arranging step a third roll-up unit of the at least three roll-up units is arranged in the roll unloading position.

* * * * *